US007922281B2

(12) United States Patent
Yano

(10) Patent No.: US 7,922,281 B2
(45) **Date of Patent: *Apr. 12, 2011**

(54) PROTECTION DEVICE FOR AN INK CARTRIDGE STORAGE UNIT

(75) Inventor: Hiroyasu Yano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1015 days.

This patent is subject to a terminal disclaimer.

(21) Appl. No.: 11/693,459

(22) Filed: Mar. 29, 2007

(65) Prior Publication Data

US 2007/0229582 A1 Oct. 4, 2007

(30) Foreign Application Priority Data

Mar. 31, 2006 (JP) ..... 2006-100498

(51) Int. Cl.
*B41J 2/165* (2006.01)
*B41J 2/17* (2006.01)
*B41J 2/175* (2006.01)

(52) U.S. Cl. ..... 347/29; 347/84; 347/86

(58) Field of Classification Search ..... 347/22, 347/37, 84–86, 108, 29; 206/320
See application file for complete search history.

(56) References Cited

U.S. PATENT DOCUMENTS

| | | | | |
|---|---|---|---|---|
| 6,039,443 | A * | 3/2000 | Dunphy et al. | 347/92 |
| 6,132,036 | A | 10/2000 | Abe et al. | |
| 6,827,417 | B2 | 12/2004 | Seino et al. | |
| 2007/0229625 | A1 | 10/2007 | Yano | |

FOREIGN PATENT DOCUMENTS

| | | | |
|---|---|---|---|
| EP | 1602487 | A1 | 7/2005 |
| JP | H09-076525 | A | 3/1997 |
| JP | H1157094 | A | 6/1999 |
| JP | 2003054000 | A | 2/2003 |
| JP | 2003-312005 | A | 11/2003 |
| JP | 2004-017446 | A | 1/2004 |
| JP | 2005238857 | A | 9/2005 |

* cited by examiner

*Primary Examiner* — Manish S Shah
*Assistant Examiner* — Geoffrey Mruk
(74) *Attorney, Agent, or Firm* — Baker Botts L.L.P.

(57) ABSTRACT

A protection device for an ink cartridge storage unit having an ink inducing member is provided with a supporting beam, a funnel member having a narrow conical end and a wide conical end, the narrow conical end being connected to a distal end of the supporting beam, and an elastic cap arranged inside the funnel member. The elastic cap seals the ink inducing member in an engaged state. In the course of removing the protection device from the ink cartridge storage unit, the protection device can be lifted in the upper direction. The upper rim of the wide conical end makes contact with the rear surface of the ink cartridge storage unit in due course. As the protection device is lifted further, the part of the elastic cap is constricted, and the upper rim of the wide conical end functions as the fulcrum for the leverage.

9 Claims, 14 Drawing Sheets

PROTECTION DEVICE FOR AN INK CARTRIDGE STORAGE UNIT

CROSS-REFERENCE TO RELATED APPLICATION

This application claims priority to Japanese Patent Application No. 2006-100498, filed on Mar. 31, 2006, the contents of which are hereby incorporated by reference into the present application.

BACKGROUND OF THE INVENTION

1. Field of the Invention

The present invention relates to a protection device for a storage unit (a refill unit) of ink cartridges utilized in an ink jet printer.

2. Description of the Related Art

An ink jet printer known in general has a housing in which a print head, one or more ink tanks (ink cartridges), and a carriage is installed. The print head includes a nozzle for discharging ink, and is arranged on the carriage. The carriage is able to move in the perpendicular direction with respect to a printing medium (a sheet of printing paper, for example); that is, the carriage is able to move in the main scanning direction. The print head is connected to the ink tank, and discharges the ink provided therefrom via the nozzle. The printing medium is conveyed through the housing of the ink jet printer, and the ink discharged from the nozzle is printed thereon.

The ink jet printers can be roughly categorized into two types: an on-carriage type, and an off-carriage type. Such categorization can be made based on the arrangement of the ink cartridge. The on-carriage type and the off-carriage type both include a storage unit, or a storage case for detachably storing the ink cartridge. The on-carriage type has the storage unit arranged on the movable carriage. With this type of carriage, the ink is provided directly from the storage unit to the print head. On the other hand, the off-carriage type has the storage unit arranged inside the housing, but not on the movable carriage. The ink cartridge stored in the storage unit is connected to the print head by a relaying member; for example, an ink tube. The ink is provided from the remote storage unit to the print head that is supported on the carriage via the ink tube.

With either of the types of ink jet printers as described above, the ink cartridge must be replaced with a new one, or be refilled, when the volume of remaining ink becomes insufficient.

With the typical types of ink jet printers as described above, the storage unit has an ink inducing member that provides ink to the print head. Correspondingly, the ink cartridge has a connecting portion, such as an ink providing valve. To provide the ink to the print head from the ink cartridge, the ink inducing member of the storage unit is connected to the connecting portion of the ink cartridge. In a case where the ink inducing member is in the shape of a narrow needle or tube, the ink inducing member is easily bent or broken in the course of installing and removing the ink cartridge to and from the storage unit. Thus, a guiding portion, for example, a plurality of guiding ribs or a guiding tube section are formed on the periphery of the ink inducing member, while an insert tube corresponding to the aforementioned guiding ribs or the guiding tube section is formed on the connecting portion of the ink cartridge, to insert therein.

Inkjet printers of both the on-carriage type and the off-carriage type undergo a print test before shipment. The print test is performed to confirm that the printing mechanism is functioning. In such a test, one or more ink cartridge is installed in the storage unit, and after the print test, the ink cartridge is removed from the storage unit before shipment. The ink inside the print head can be left or removed prior to shipment. In the case where the ink is removed from the print head, the print head is refilled with a preservative liquid which has the same characteristic as the ink without pigments or dyestuffs. Then, a protection device, such as a protection cap or a dummy cartridge (that is, a cartridge with no ink inside), is installed in the case to cover the ink inducing member. The protection device prevents the leakage of the ink or the preservative liquid (the term "liquid" will be used as the general term for both the ink and the preservative liquid in the description below). The surface of the print head on which the nozzle is arranged is also covered with a nozzle cap to prevent the leakage of the liquid, and for the protection of the nozzle. Such a technique is taught in the Japanese Patent Application Publications No. 2002-79690, No. 2004-230857, No. 2005-238857, and No. 2003-54000.

Hence, in order to seal the tube or needle shaped ink inducing member, a rubber cork (see FIG. 3 of the Japanese Patent Application Publication No. 2002-79690), or a sealing portion (see Japanese Patent Application Publication No. 2005-238857 and No. 2003-54000) is arranged on the protection device.

In the above-mentioned case of sealing the tube or needle shaped ink inducing member with the protection device, the rubber cork or a rubber cap is arranged on the protection device. However, if the protection device is installed or removed in an improper position or angle, the ink inducing member is bent or broken.

Moreover, in the course of transporting the ink jet printer, the environmental condition of the ink jet printer may change; for example, following impact from vibrations due to transportation, the seal between the protection device and ink inducing member may be loosened, resulting in ink leakage. Or, a change in temperature, and/or change in atmospheric pressure may occur. If air and liquid remain inside the sealed portion, the aforementioned changes cause the volume of the air and liquid to change, resulting in a loosening of the seal and ink leakage. Therefore, the cork ( or the rubber cap) of the protection device must be sealed tightly in order to prevent the occurrence of undesirable conditions described in the above-mentioned cases. For this reason, the cork (that is, the protection device) is tightly inserted into or engaged with the ink inducing member.

In such case, however, excessive force is required in the process of removing the protection device, and if the removal direction is not parallel to the ink inducing member, the ink inducing member is bent or broken.

BRIEF SUMMARY OF THE INVENTION

The objective of the present invention is to provide a protection device for the ink cartridge storage unit, maintaining the essential function of preventing the leakage and the dehydration of liquid as well as the function of preventing the bending and breaking of the ink inducing member, while also ensuring that the protection device can be installed and removed easily. To achieve such an objective, the following technique taught in the present specification was developed.

The protection device disclosed in the present specification is applied to an ink cartridge storage unit having a storage main body with one side having an opening, an ink inducing member arranged on a surface of the main body facing the side having the opening, in a manner that the ink inducing member vertically protrudes inside the main body with respect to the surface. The protection device includes a main body, a supporting beam connected to the device's main body, the supporting beam protruding in a horizontal direction with respect to the ink inducing member, a funnel member having a narrow conical end and a wide conical end, the narrow conical end being connected to a distal end of the supporting beam, and an elastic cap arranged inside the funnel member, and the elastic cap seals the ink inducing member in an engaged state. When the protection device is angled toward a direction in the aforementioned engaged state, the part of the wide conical end corresponding to that direction makes contact with the surface where the ink inducing member is arranged and slides thereon.

The ink cartridge storage unit is able to store an ink cartridge. The ink cartridge can be inserted through the opening, and is connected to the ink inducing member that is arranged on the rear side surface. Ink stored inside the ink cartridge is supplied to a print head through the ink inducing member. The protection device is configured to attach to the ink inducing member as an alternative to the ink cartridge. The protection device can also be inserted through the opening. The funnel member guides the ink inducing member and the elastic cap seals the ink inducing member.

In the course of removing the protection member from the storage main body, the protection device can be lifted in the upward direction. The upper rim of the wide conical end makes contact with the rear surface of the storage main body in due course. As the device's main body is lifted further, the part of the elastic cap that is pressed against the ink inducing member is constricted, and the upper rim of the wide conical end functions as the fulcrum for the leverage (lifting). The upper rim making contact with the rear surface slides downward, while the position of the elastic cap with respect to the ink inducing member is shifted in accordance with the constriction. As the result, the elastic cap can be taken off of the ink inducing member. After the seal between the elastic cap and the ink inducing member is loosened, the protection device can be pulled out of the storage main body. Even in a case where the protection device is tightly sealed the ink inducing member, the protection device can be easily removed from the ink cartridge storage unit with small effort.

In a case in which the ink cartridge storage unit includes a guiding rib arranged along the outer periphery of the ink inducing member, the guiding rib having a surface facing the opening, it is preferred that the funnel member is configured so that a clearance is maintained between the wide conical end of the funnel member and the guiding rib of the ink cartridge storage unit in the engaged state. When the protection device is angled toward a direction, the part of the wide conical end corresponding to the direction makes contact with the surface of the guiding rib and slides thereon.

The ink cartridge storage unit may include a guiding rib on the outer periphery of the ink inducing tube. The guiding rib is formed to guide the ink cartridge in the course of insertion, and protects the connection of the ink cartridge and the ink inducing member. However, in the course of removing the protection device, if the upper rim of the wide conical end of the funnel member is caught on the side surface of the guiding rib while lifting the protection device, the protection device cannot be efficiently removed. In the aforementioned configuration, the upper rim of the wide conical end makes contact with the top surface (that is, the surface facing the opening of the storage main body) of the guiding rib. The protection device can be removed easily without the leverage being inhibited.

Furthermore, due to the clearance maintained between the wide conical end of the funnel member and the guiding rib of the ink cartridge storage unit, when the elastic cap and the ink inducing member are engaged with each other, even in a case in which the ink leaks from the ink inducing member, the funnel member can be kept clean.

With the aforementioned protection device, it is also preferred that a plurality of supporting beams ordered in a line is connected to the device main body, and a part of the wide conical end is elongated in an orthogonal direction with respect to the direction of alignment of the supporting beams.

An ink jet printer that is able to print colored images uses a plurality of colored ink. In general, inks of different colors are contained in different ink cartridges. Hence, the ink cartridge storage unit may store a plurality of ink cartridges, and a corresponding number of ink inducing members may be arranged. In such a case, the protection device must be able to seal the plurality of ink inducing members.

Furthermore, in such a case, the space between the funnel members in the horizontal direction is limited. With the elongated configuration as described above, the elongated part can be arranged at the upper part and be utilized as the leverage fulcrum when removing the protection device from the storage main body. Due to the aforementioned configuration, the protection device can be easily removed It is also preferable that the supporting beam is made of a pliable material and can be resiliently bent in the vertical direction with respect to its axis direction.

With the resilient supporting beam, the elastic cap can engage with the ink inducing member even when the ink inducing member and the supporting beam are slightly misaligned. Even in such a case, the sealing of the ink inducing member is maintained.

It is also preferable that the supporting beam and the funnel member are made of a pliable material as one hollow component.

The pliancy of the supporting beam and the funnel member enables the elastic cap to seal the ink inducing member even when a slight misalignment exists between the ink inducing member and the supporting beam. Furthermore, since the supporting beam and the funnel member are formed with a hollow interior, the pliancy thereof is improved. Along with the supporting beam and the funnel member, the device's main body can also be made of a pliable material as one component.

It is also preferable that the elastic cap includes a brim portion, and the elastic cap is detachably inserted inside the funnel member with the brim portion at the supporting beam side.

During the removal of the protection device, the elastic cap is pulled towards the ink inducing member along with friction. Such a configuration as described above prevents the elastic cap from falling out of the funnel member in the course of removing the protection device.

It is also preferable that a concave portion is formed at a connecting section of the supporting beam and the funnel member, and the brim portion of the elastic cap engages with the concave portion.

In the configuration described above, the brim portion engages with the concave portion. In addition to the pulling force exerted on the elastic cap during the removal of the protection device, the elastic cap is also pressed towards the side of the opening by the ink inducing member during the insertion of the protection device. Such a configuration as described above prevents the elastic cap from falling out of the funnel member in the course of inserting and removing the protection device.

It is also preferable that the protection device further includes a regulation plate horizontally connected to the main body with respect to the surface at which the supporting beam is connected.

With the regulation plate standing on one surface in one direction, for example, on the top surface of the device main body in the upper direction, it can be utilized to recognize the improper positioning of the protection device. For example, if the protection device is inserted with its bottom side up, the regulation plate can prohibit the funnel member from covering the ink inducing member. Such misalignment can be recognized easily, thus preventing damage of the ink inducing member.

With the aforementioned configuration of the regulation plate, it allows the movement of the protection device in the horizontal direction with respect to the regulation plate.

DETAILED DESCRIPTION OF THE INVENTION

The preferred embodiment of the present invention will be described in detail below with reference to the figures.

Figure 1:
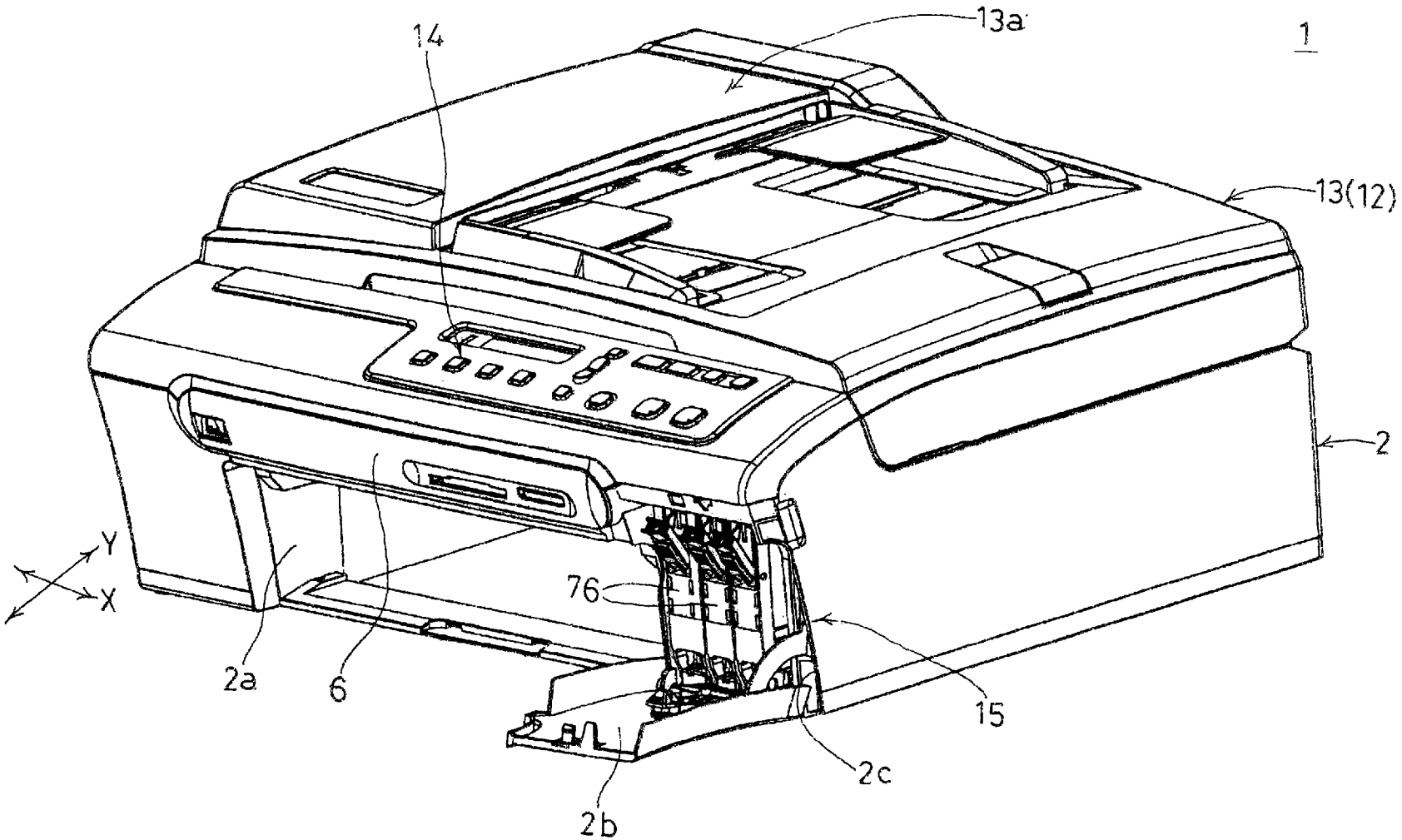
FIG. 1 shows a perspective view of a multi-function device of the present embodiment.

FIG. 1 shows a perspective view of a multi-function device of the present embodiment. As shown in FIG. 1, the present invention is incorporated into a multi-function device 1 (it may also be referred to as MFD 1 in the description below) in the present embodiment. The MFD 1 comprises printing function, scanning function, copying function, facsimile function, etc. The MFD 1 is connected to a computer not shown in the figures, and operates the above-mentioned functions according to the orders and data sent therefrom. The MFD 1 is also able to connect to an external device, such as a digital camera, and perform printing functions according to the orders and data sent therefrom.

In the descriptions below, the expressions regarding the front and rear directions (that is, the direction corresponding to the Y axis in FIG. 1) will be described with respect to the side where the opening 2*a* of the housing 2 is defined as the front side. The expressions regarding the left and right directions (that is, the direction shown with X axis in FIG. 1) will be described with respect to the front view of the MFD 1.

The MFD 1 comprises a box-shaped housing 2 made of synthetic resin. At the front side of the housing 2, a slot member 6 is positioned. Memory devices or media such as memory cards can be inserted into the slot member 6. The MDF 1 can operate its printing function according to the data stored therein.

Above the slot member 6, an operation panel 14 is situated on the upper front part of the housing 2. The operation panel 14 comprises operation buttons and a LCD monitor. Operation orders can be inputted by manually operating the operation panel 14.

A scanner 12 is fixed on the upper part of the housing 2 of the MFD 1. The scanner 12 is utilized in operating functions such as the copying function and the facsimile function.

On the top surface of the scanner 12, a glass plate (not shown in the figures) is arranged, and a Contact Image Sensor (CIS, not shown in the figures) is installed underneath the glass plate. The CIS is able to move in the leftward and rightward direction, that is, the direction corresponding to axis X in FIG. 1.

The scanner 12 has a scanner cover 13 arranged on its top. The scanner cover 13 is hinged to the main body of the scanner 12 at the rear edge. The scanner cover 13 can rotate with respect to the glass surface between a closed state that the scanner cover 13 covers the glass plate, and an opened state that exposes the glass plate. The scanner cover 13 also includes an auto document feeder (ADF) 13*a*.

Figure 3:
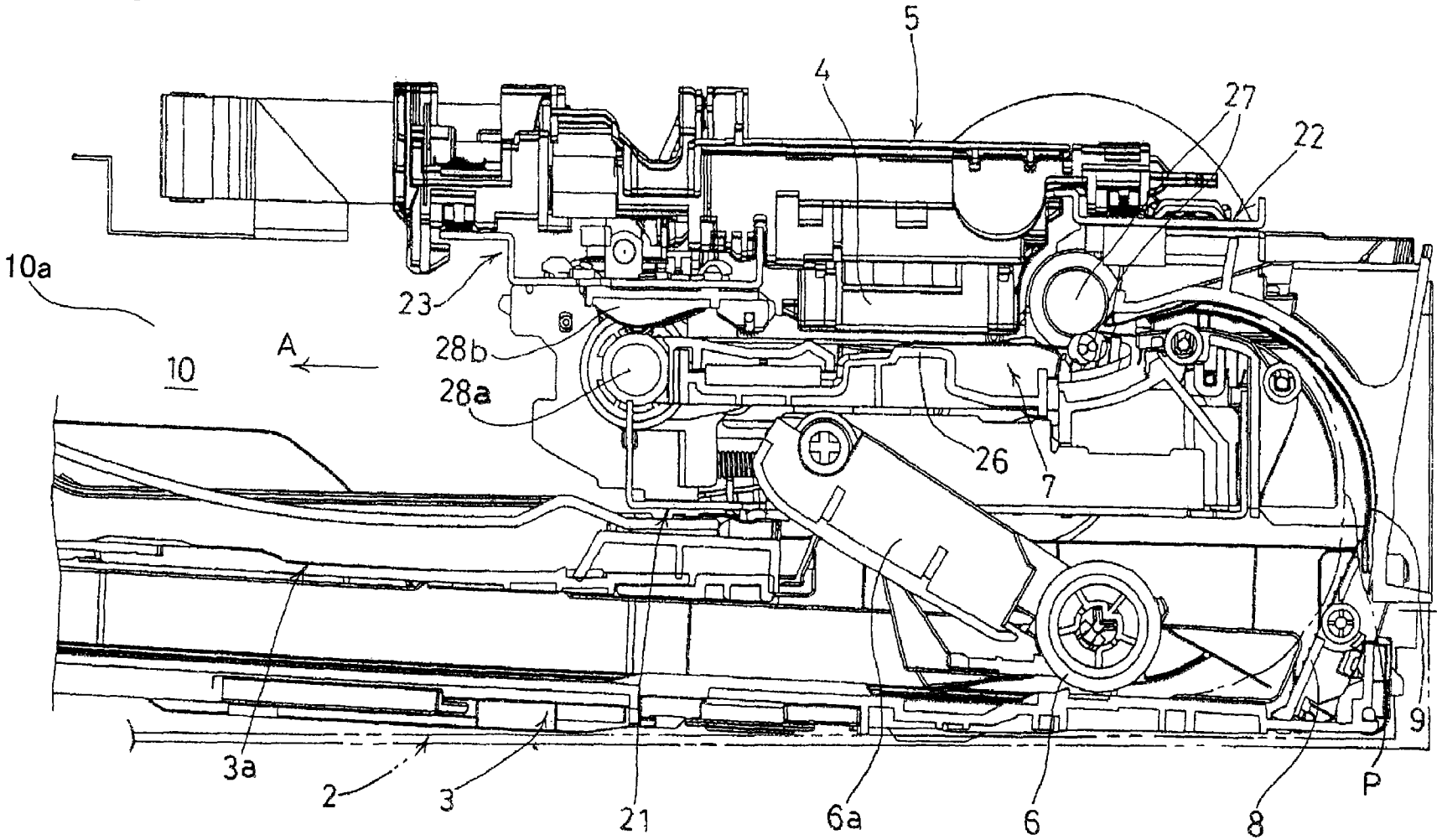
FIG. 3 shows a cross sectional view of a printer.

In the lower part of the housing 2 that is shown in FIG. 1, a printer 7 is arranged below the scanner 12. Below the printer 7, a paper feeding mechanism is arranged. FIG. 3 shows a cross sectional view of the printer 7 and the lower part of the housing 2. As shown in FIG. 3, inside the bottom part of the housing 2, a space for storing the paper feed-in cassette 3 is provided. This space has an opening 2*a* located in the front side of the housing 2 (also see FIG. 1). The paper feed-in cassette 3 can be inserted into and detached from the housing 2 from the front side through the opening 2*a* in the horizontal direction with respect to the bottom surface of the housing 2.

In the present embodiment, a plurality of sheets of printing paper P can be stored in the paper feed-in cassette 3 in a stacked state. The paper feed-in cassette 3 is able to store printing paper P of various sizes, such as A4 size, letter size, legal size, postcard size, etc. The plurality of sheets of printing paper P can be stacked with the shorter side (the widthwise side) of the stack of printing paper P perpendicularly intersecting with the feed-in direction of the printing paper P (the direction corresponding to axis Y in FIG. 1).

In the upper part of the paper feed-in cassette 3, a secondary feed-in cassette 3*a* is arranged. The secondary feed-in cassette 3*a* can store stacks of paper of small sizes, and is slidable, in the Y-axis direction, on the paper feed-in cassette 3. The paper feed-in cassette 3 and the secondary feed-in cassette 3*a* shown in FIG. 3 are abbreviated in FIG. 1.

As shown in FIG. 3, at the rear side of the paper feed-in cassette 3, an inclined separator 8 is arranged. A paper feed-in arm 6*a* facing the inclined separator 8 is equipped on the housing 2. That is, one end of the paper feed-in arm 6*a* is connected to the housing 2, and the other end of the paper feed-in arm 6*a* rotates in the up and down direction with respect to the end connected to the housing 2. At the other end of the paper feed-in arm 6*a*, a paper feed-in roller 6 is arranged. The paper feed-in roller 6 and the inclined separator 8 send out the topmost sheet of printing paper P from the stack in the paper feed-in cassette 3 at a time.

The sheet of printing paper P separated from the stack is fed through the U-shaped passage 9 (that is, the paper feeding passage) in the upper direction. The printing paper P is fed into the printer 7, which is located on the upper rear part of the housing 2 and above the paper feed-in cassette 3. The printer 7 operates the printing function, and prints images on the printing paper P by discharging ink thereon.

After the printing paper P is conveyed through the printer 7, and an image is printed thereon, the printing paper P is fed out onto a paper feed-out member 10. The paper feed-out member 10 is located above the paper feed-in cassette 3. The paper feed-out member 10 includes a feed-out opening 10*a*. The feed-out opening 10*a* is included in the front opening 2*a* as the upper part thereof.

As shown in FIG. 1, next to the front opening 2*a*, an ink cartridge storage unit 15 is arranged. The ink cartridge storage unit 15 is fixed to the bottom surface of the main body. Furthermore, a cover 2*b* for the ink cartridge storage unit 15 is hinged to the housing 2. The cover 2*b* is connected to the housing 2 with a hinge that connects a bottom edge of the cover 2*b* and a part of the lower front side of the housing 2. As shown in FIG. 1, the cover 2*b* can rotate with respect to the ink cartridge storage unit 15 between a closed state that the cover 2*b* covers the ink cartridge storage unit 15, and an opened state that the ink cartridge storage unit 15 is exposed. The ink cartridge storage unit 15 is connected to the printer 7 with a relaying member to provide ink thereto.

Figure 2:
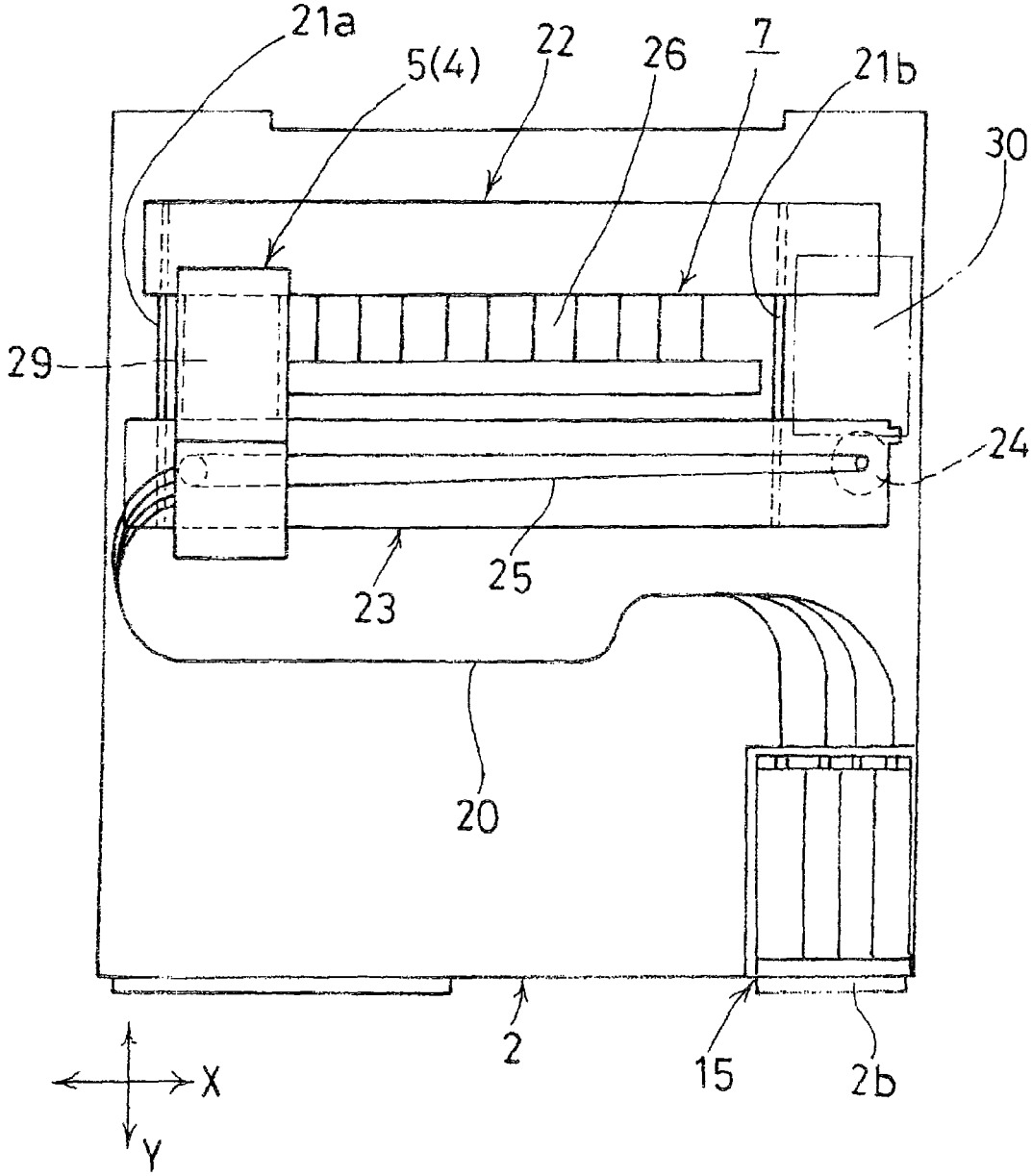
FIG. 2 shows a plane view of a housing (main body) with the upper case removed.

FIG. 2 shows a plane view of the lower part of the housing 2 with the upper part (the scanner 12) removed. The printer 7 is connected to the ink cartridge storage unit 15 by a plurality of ink tubes 20. The ink stored inside the ink cartridge storage unit 15 is provided to the printer 7 through the ink tubes 20. Each ink tube 20 is arranged to provide ink of one color type; that is, as shown in FIG. 2, FIG. 4 and FIG. 5, four types of ink are stored in the ink cartridge storage unit 15 in the present embodiment.

Figure 4:
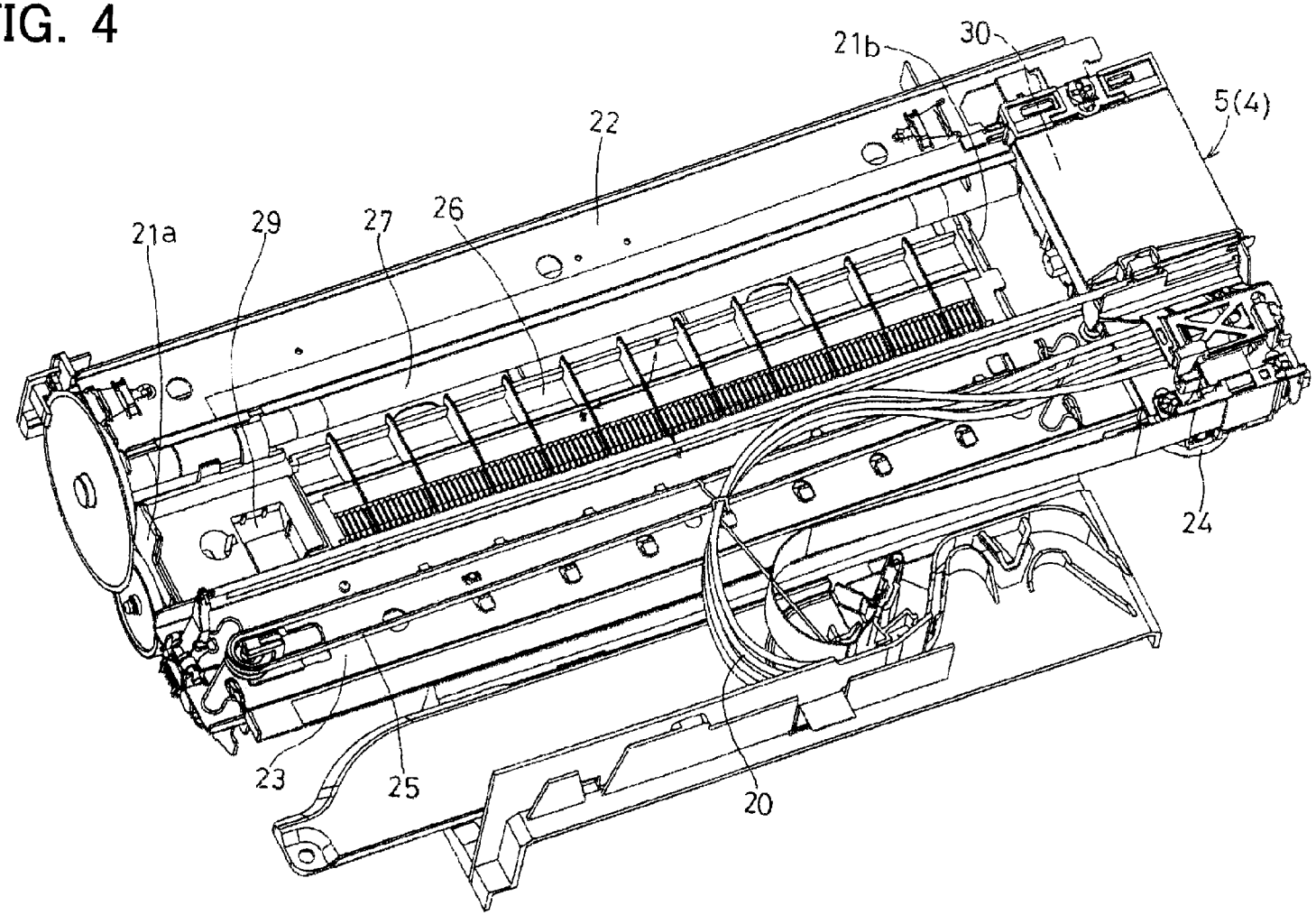
FIG. 4 shows a perspective view of a printer.
Figure 5:
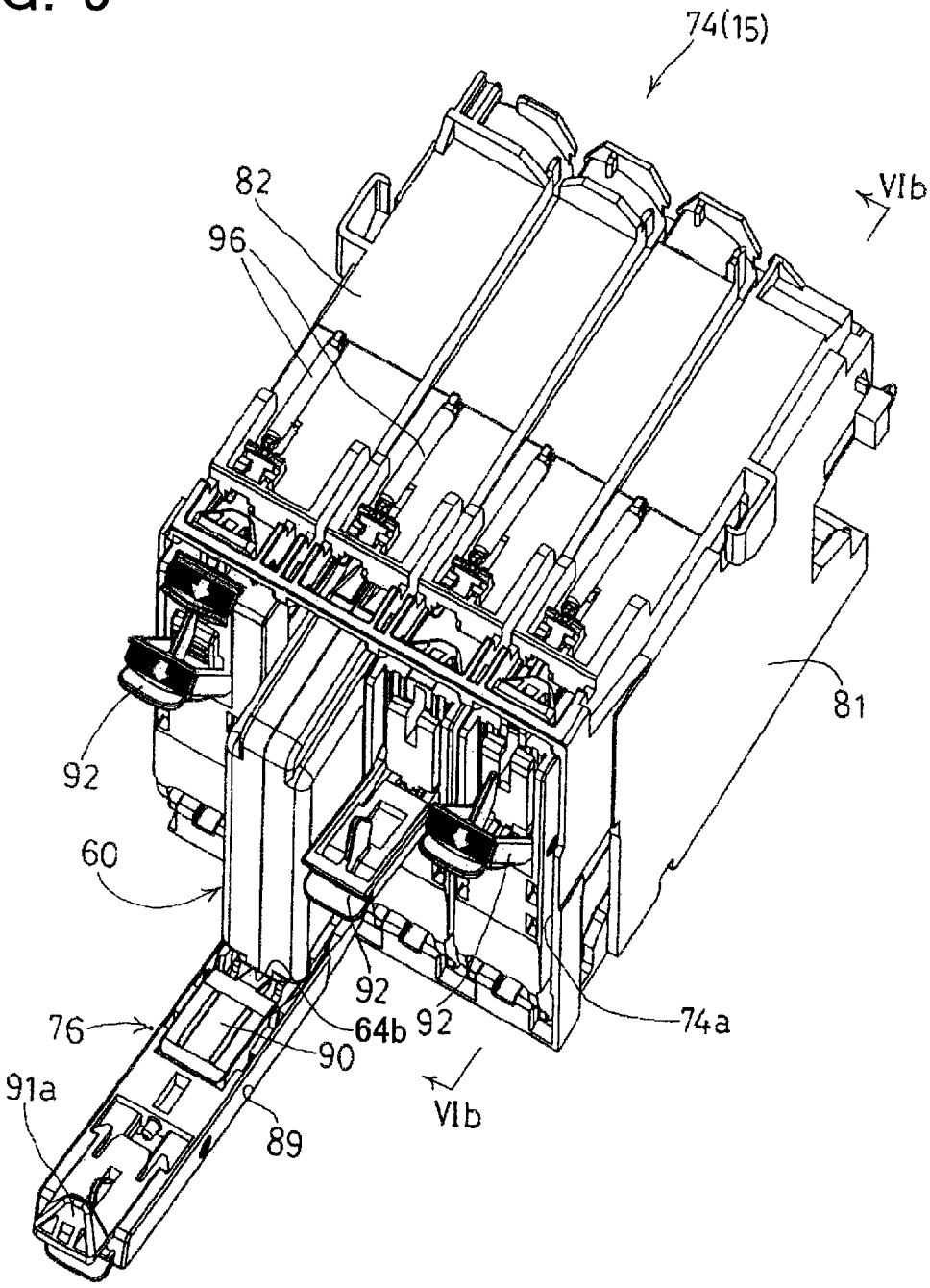
FIG. 5 shows a perspective view of an ink cartridge storage unit.

FIG. 4 shows a perspective view of the printer 7. As shown in FIG. 2 and FIG. 4, the printer 7 is supported by a main frame 21. More specifically, the printer 7 is supported by a pair of side plates 21*a* and 21*b* of the main frame 21, which are located on the left and right side respectively. The printer 7 farther includes a first guiding member 22 and a second guiding member 23. The first and second guiding members 22, 23 are flat plates that extend in the direction of axis X (shown in FIG. 1). The first and second guiding members 22, 23 slidably support a carriage 5. The carriage 5 includes a print head 4, and is configured so that it is able to slide back and forth in the direction of axis X. The carriage 5 is moved by a timing belt 25 and a carriage motor (CR motor) 24. The timing belt 25 is a loop belt wound around a pulley, and it is extending above and parallel to the second guiding member 23. A part of the timing belt 25 is fixed to the carriage 5. The driving force from the CR motor 24 is transmitted to the timing belt 25 through the pulley; thus the carriage 5 is driven by the driving force from the CR motor 24. In the present embodiment, the CR motor 24 is a DC motor. However, it can be substituted by other types of motors (a stepping motor, for example).

Under the print head 4 and between the first and second guiding members 22, 23, a platen 26 is arranged. The platen 26 has the shape of a flat rectangular plate, and it supports the sheet of printing paper P that is conveyed underneath the print head 4. The first guiding member 22 is located on the upstream side and the second guiding member is located on the downstream side with respect to the direction the sheet of printing paper P is conveyed (that is, the direction shown with arrow A in FIG. 3).

A tape scale (not shown in the figures), a component of an optical linear encoder utilized to detect the position of the carriage 5 in the direction of axis X and the speed at which it is moving in that direction, is also included in the printer 7.

A pair of resist rollers 27 is arranged along the widthwise direction of the platen 26. The platen 26 is located between the pair of resist rollers 27 in the vertical direction (the up and down direction). The pair of resist rollers 27 is located on the first guiding member 22 side with respect to the direction of axis Y. As shown in FIG. 3, the pair of resist rollers 27 feed the sheet of printing paper P in between the platen 26 and the print head 4.

On the downstream side of the platen 26, a feed-out roller 28*a* and a spur roller 28*b* are arranged. After being conveyed underneath the print head 4, the sheet of printing paper P is fed out to the paper feed-out member 10 by the feed-out roller 28*a* and the spur roller 28*b*.

Furthermore, as shown in FIGS. 2 and 4, an ink receptor 29 is arranged on one side of the platen 26, and a maintenance unit 30 is arranged on the other side of the platen 26. In the present embodiment, the ink receptor 29 is arranged between the side plate 21*a* and the platen 26, and the maintenance unit 30 is arranged on the right side of the side plate 21*b*. The ink receptor 29 is utilized as a flushing position for the print head 4. The print head 4 (or the carriage 5) periodically slides to the flushing position, that is, above the ink receptor 29, during the printing operation in order to discharge ink for the purpose of preventing nozzle clog. The ink receptor 29 receives the ink discharged therefrom.

The maintenance unit 30 is utilized for a stand by position for the carriage 5. The maintenance unit 30 is operated in processes such as a process for selectively absorbing ink of different colors, a recovery process for removing air bubbles from a buffer tank (not shown in the figures) arranged above the print head 4, and/or the like.

Though not shown in the figures, the maintenance unit 30 further includes a wiper member. The wiper member cleans the nozzle surface of the print head 4 when the carriage 5 slides into the printing region (that is, above the platen 26) from the stand by position.

The configuration of the ink cartridge storage unit 15 will be described below. FIG. 5 shows a perspective view of the ink cartridge storage unit 15. The ink cartridge storage unit 15 includes a storage main body 74 for storing a plurality of ink cartridges 60. In the present embodiment, four ink cartridges 60 can be stored, aligned in parallel, in the direction of axis X inside the storage main body 74. Four storage covers 76 are connected to the lower front part of the storage main body 74. Each storage cover 76 rotates with respect to the main body 74 between an opened state (shown with the second storage cover 76 to the left in FIG. 5), and a closed state (shown with the storage covers 76 in FIG. 12A).

Figure 6A:
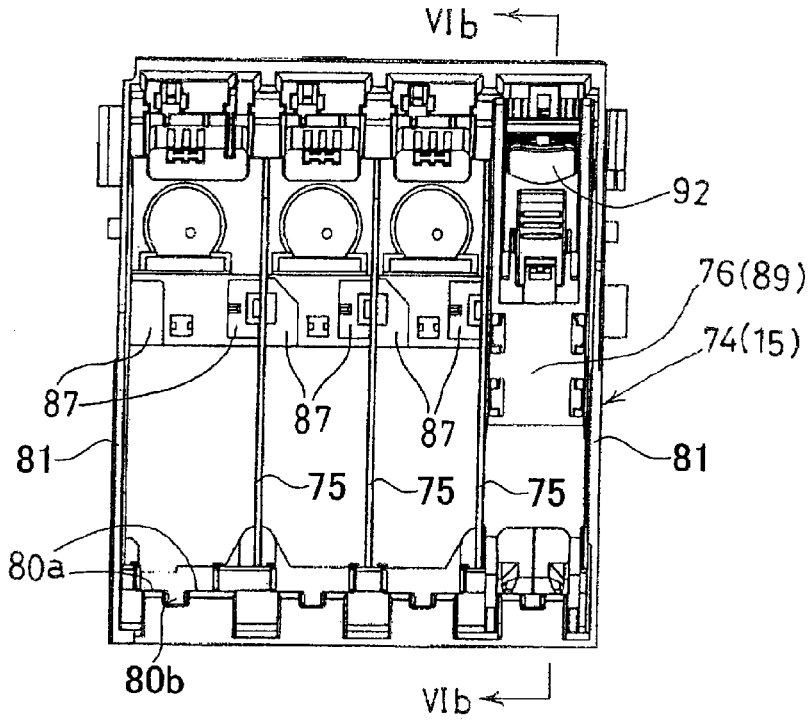
FIG. 6A shows a front view of an ink cartridge storage unit.
Figure 6B:
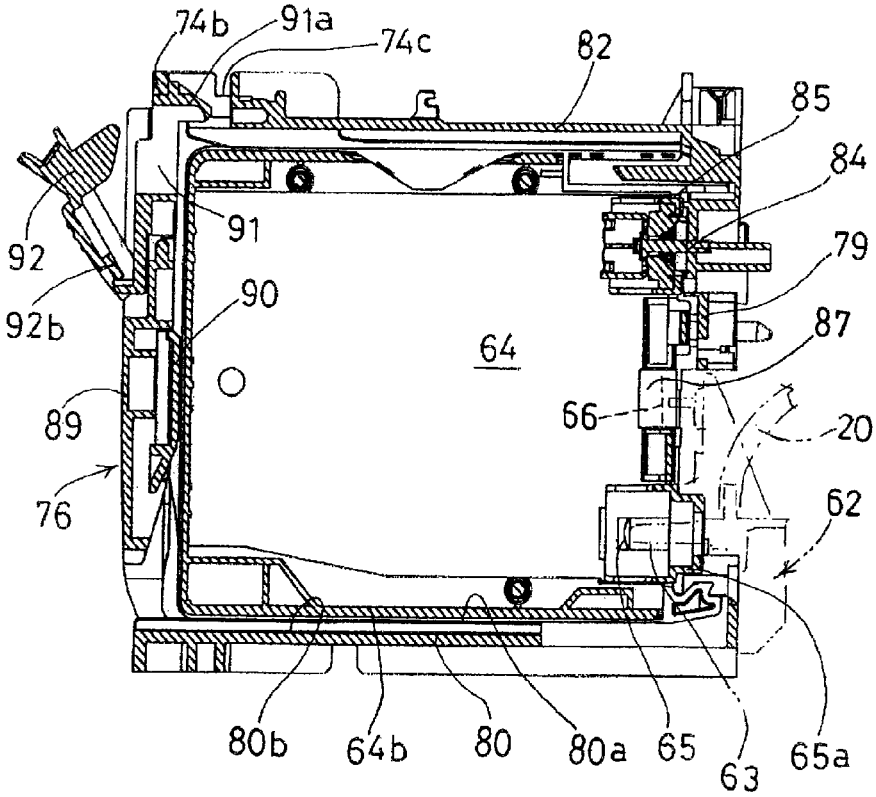
FIG. 6B shows a cross sectional view along the line VIb-VIb of FIG. 5.

The storage main body 74 of the ink cartridge storage unit 15 is made of resin, for example, in a rectangular parallelepiped shape. FIG. 6A shows a front view of the ink cartridge storage unit 15, and FIG. 6B shows a cross sectional view along the line VIb-VIb of FIG. 5. As shown in FIGS. 5, 6A and 6B, the storage main body 74 includes a bottom plate 80, a pair of side plates 81, a top plate 82, and a rear plate 79. The side plates 81 are vertically connected to the bottom plate 80, and the top plate 82 is attached on top of the side plates 81. The side plates 81 are connected by the rear plate 79, which is arranged at the upper part (a part close to the top plate 82) of the rear wall. The front part of the storage main body 74 has an opening 74*a*, where the ink cartridges 60 can be inserted or removed therefrom. Inside the storage main body 74, as shown in FIG. 6, a plurality of separators 75 is arranged (also see FIGS. 9, 11 and 12B). The separators 75 divide the space inside the storage main body 74 into several storage rooms 78, into which the ink cartridges 60 can be installed respectively. Depending on the number of ink cartridges 60, a corresponding number of separators 75 are arranged inside the storage main body 74.

In the present embodiment, the storage main body 74 has four storage rooms 78. Each storage room 78 is configured so that the corresponding ink cartridge 60 can be inserted and removed from the front side opening 74*a*. The interior surfaces of the storage room 78 are formed to fit with the corresponding surfaces of the ink cartridge 60. Due to this configuration, the ink cartridge 60 can be stored stably in the storage room 78.

The separator 75 does not need to distinctly divide the storage rooms 78. The separators 75 can be formed as ribs in order to separate the storage rooms 78 at least at the rear side (the side closest to the rear plate 79). It is preferred that the bottom plate 80, the side plates 81, the top plate 82, the rear plate 79 and the separator 75 to be formed as one component.

In the present embodiment, as clearly shown in FIGS. 6A and 6B, the storage main body 74 has a pair of guiding rails 80*a* arranged at the surface of the bottom plate 80. Each guiding rail 80*a* has a flat surface, and the ink cartridge 60 is placed thereon. The guiding rails 80*a* extend from the front opening 74*a* towards the rear plate 79, and guide the ink cartridge 60 along that direction in the course of inserting and removing the ink cartridge 60 from the storage main body 74. Moreover, a groove 80*b* is formed between the pair of guiding rails 80*a*. In a case where an ink leak occurs, the groove 80*b* between the pair of guiding rails 80*a* is utilized as a drain for the leaking ink.

Figure 7A:
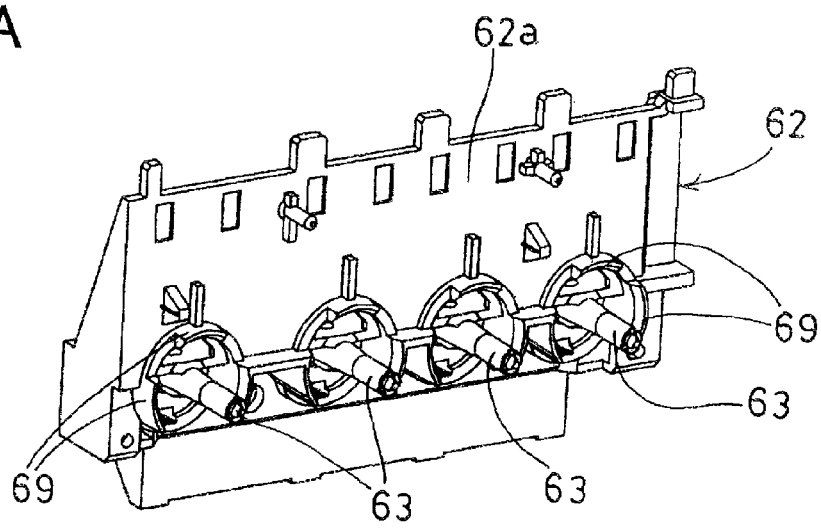
FIG. 7A, FIG. 7B and FIG. 7C show perspective views of a connector from different angles.
Figure 7B:
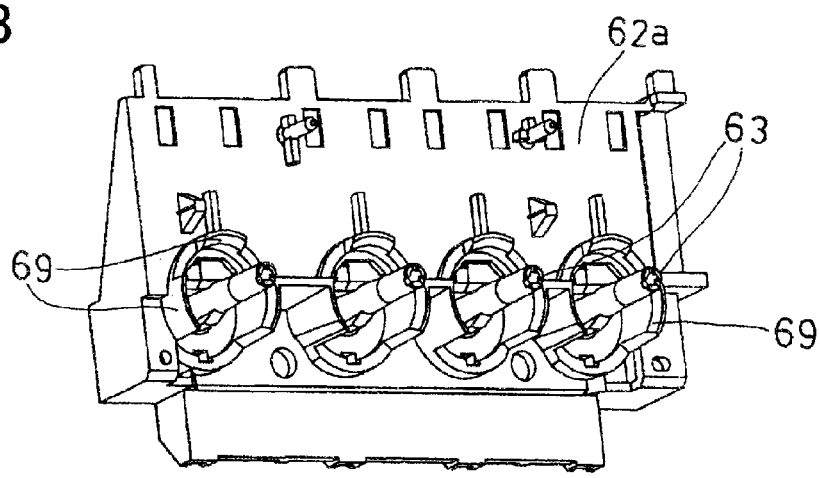
Figure 7C:
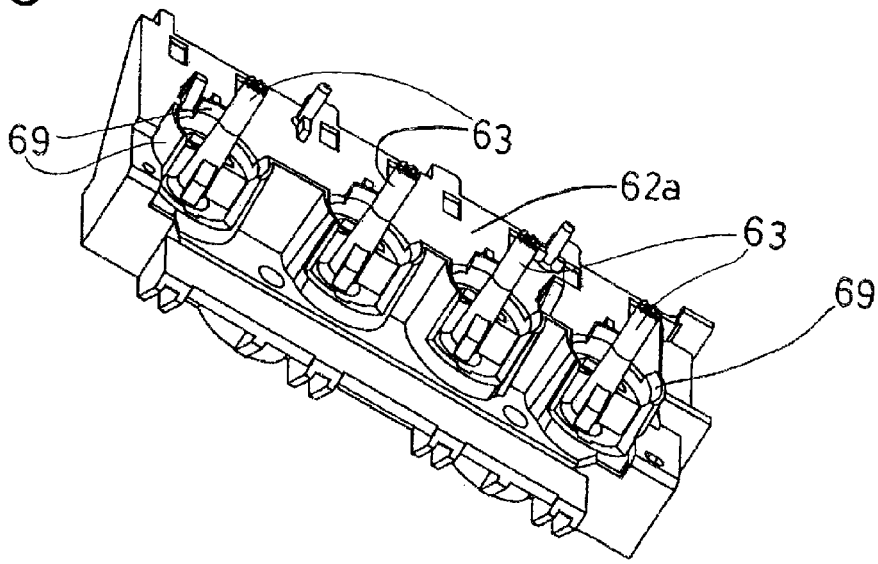

Furthermore, as shown in FIG. 6B, the cartridge storage unit 15 includes a connector 62. The connector 62 connects the ink cartridge 60 and the ink tube 20. FIG. 7A, FIG. 7B and FIG. 7C show perspective views of the connector 62 from different angles. The connector 62 includes a rectangular plate 62*a*, and a plurality of ink inducing tubes 63. The ink inducing tube 63 is in the shape of a needle or a tube, and is formed in unity with and penetrating through the rectangular plate 62*a*. The ink inducing tube 63 is connected to one end of the ink tube 20, as shown in FIG. 6B. The other end of the ink tube 20 is connected to the print head 4 of the carriage 5 (see FIG. 2), and is configured to provide the ink to the print head 4. The rectangular plate 62*a* fixedly covers the lower part of the rear plate 79 of the storage main body 74, and the other end of the ink inducing tube 63 (the protruding part shown in FIGS. 7A, 7B and 7C), vertically protrudes inside the storage main body 74 with respect to the rear plate 79. A plurality of arc-shaped guiding ribs 69 is arranged on the outer periphery of the ink inducing tube 63. The guiding ribs 69 are utilized to guide the ink cartridge 60 in the course of connecting the ink cartridge 60 to the ink inducing tube 63.

In the present embodiment, the four aforementioned ink colors are utilized. Therefore, four sets of ink inducing tubes 63 and ink tubes 20 are arranged. The number of the sets can be configured to correspond to the number of ink cartridges 60 utilized for the printer 7. For example, in a case where six to eight different colors are used, the ink cartridge storage unit 15 is configured to store six to eight ink cartridges, and a corresponding number of ink inducing tubes 63 and ink tubes 20 are arranged.

The configuration of the ink cartridge 60 will be described below. As shown in FIGS. 5 and 6B, the ink cartridges 60 each includes a cartridge main body 64 made of synthetic resin. As is clear from FIG. 6A, the cartridge main body 64 has the shape of a rectangular box whose front view area (its width) is narrow, and the vertical height is long. The cartridge main body 64 is formed as a rectangular parallelepiped box with thin walls, and a space for storing ink cartridges is formed therein. The cartridge main body 64 is composed of two tray shaped members. The two tray members are welded or adhered to compose the left and right side of the main body 64. The width of the cartridge main body 64 is defined by the distance between two walls parallel to the direction of axis Y.

As described above, the ink cartridge storage unit 15 of the present embodiment is able to store four ink cartridges 60 of different colors, each holding different colors of ink: black (BK), cyan (C), magenta (M) and yellow (Y). When the ink cartridges 60 are installed inside the storage main body 74, they can be arranged parallel in the aforementioned color order. Furthermore, as clearly shown in FIG. 1, FIG. 5 and FIG. 6A, the ink cartridge 60 for BK ink is larger than the other ink cartridges 60 in the widthwise direction (the direction of axis Y). Such a configuration is based on the fact that the demand for black ink exceeds the demands for other colors, thus the black ink is consumed most. In the present embodiment, the construction and configuration of the ink cartridges 60 for colors other than black is identical.

At the rear side of the main body 64 (the side facing the rear plate 79 of the storage main body 74), an air valve 85 is arranged on the upper part (see FIG. 6B). In the present embodiment, a checking valve (not shown in the figures) is installed inside the air valve 85. Furthermore, a pushing rod 84 is connected to the air valve 85. The pushing rod 84 protrudes towards the inserting direction of the ink cartridge 60. The pushing rod 84 is able to move in the inserting direction between a state of protruding outside the air valve 85 and a state of being pushed back inside the air valve 85. When the ink cartridge 60 is inserted into the storage main body 74, and the rear side surface of the ink cartridge 60 makes contact with the rear plate 79, the pushing rod 84 is pushed back inside the air valve 85. As a result, the checking valve inside the air valve 85 opens. When the ink cartridge 60 is removed from the storage main body 74, that is, when the rear surface of the cartridge main body 64 is pulled away from the rear plate 79, the pushing rod 84 is brought out into the state of protruding outside the air valve 85. The checking valve is closed as the result of the pushing rod 84 being pulled out of the air valve 85.

Furthermore, at the lower part of the rear side surface of the cartridge main body 64, an ink inducing valve 65 is arranged. The ink inducing valve 65 is arranged inside a guiding tube 65*a* (see FIG. 6B). In the course of inserting the ink cartridge 60 into the storage main body 74, the guiding ribs 69 of the connector 62 guide the ink inducing valve 65 during the course of the insertion. As the result of the insertion, the arc-shaped guiding ribs 69 are engaged with the outer periphery of the guiding tube 65*a*. Thus, the ink inducing valve 65 of the ink cartridge 60 and the ink inducing tube 63 of the ink cartridge storage unit 15 are connected. Ink is provided from the ink cartridge 60 to the print head 4 through the aforementioned connection of the ink inducing valve 65 and the ink inducing tube 63, and through the ink tube 20 connected to the ink inducing tube 63.

As shown in FIG. 6B, on the rear side surface of the cartridge main body 64, a sensed portion 66 is arranged. Inside the cartridge main body 64, a movable device not shown in the figures that can function as a sensed actuator is arranged. The actuator is able to move in accordance with the amount of ink remaining inside the cartridge main body 64.

On the other hand, the storage main body 74 includes a liquid level sensor 87 (for example, a photo interrupter). The liquid level sensor 87 is arranged on the rear side surface of the main body 74, at a place where the liquid level sensor 87 is able to detect the movement of the actuator via the sensed portion 66. The liquid level sensor 87 detects whether the actuator is within the sensing range, and monitors the level of ink remaining.

Figure 9:
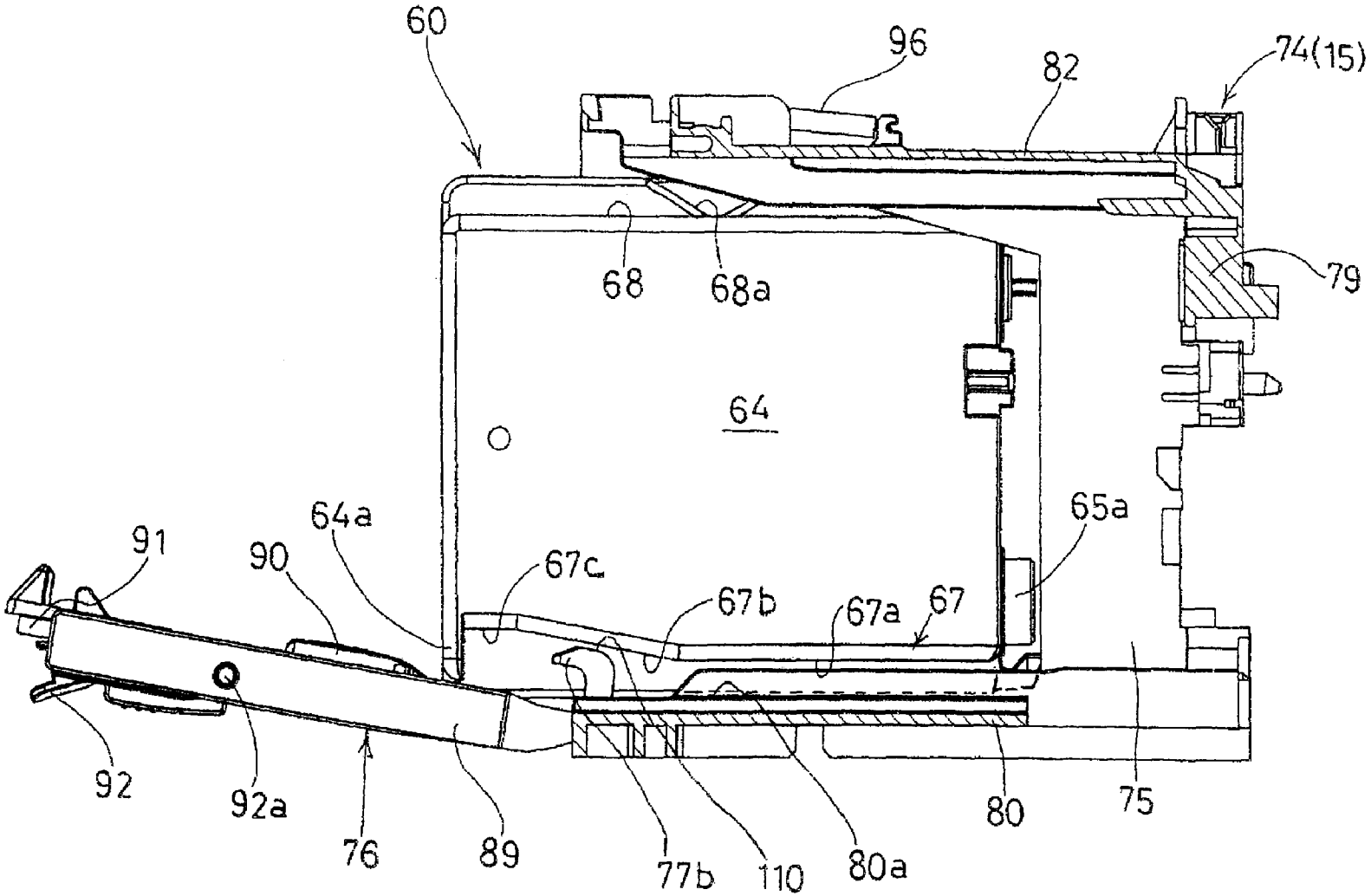
FIG. 9 shows a cross sectional side view of an ink cartridge being removed from an ink cartridge storage unit.

As shown in FIG. 9, a groove 68 is formed at the top surface of the cartridge main body 64. The groove 68 extends in the lengthwise direction of the cartridge main body 64. Furthermore, a concave portion 68*a* is formed in an approximately intermediate area of the groove 68. The concave portion 68*a* is a v-shaped indentation, including the angled surfaces at the front side and the rear side respectively.

The aforementioned L-shaped swing arm (not shown) arranged on the top plate 82 of the storage main body 74 is guided along the groove 68 in the course of installing and removing the ink cartridge 60 from the storage main body 74. In the course of removing the ink cartridge 60 from the storage main body 74, the ink cartridge 60 is slightly pulled out of the storage room 78 by the rotation of the storage cover 76. Then, when the distal end of the swing arm is engaged with the concave portion 68*a*, the ink cartridge 60 is further pushed out to a position, for example, as shown in FIG. 9 by the force transmitted from the swing arm.

Figure 8:
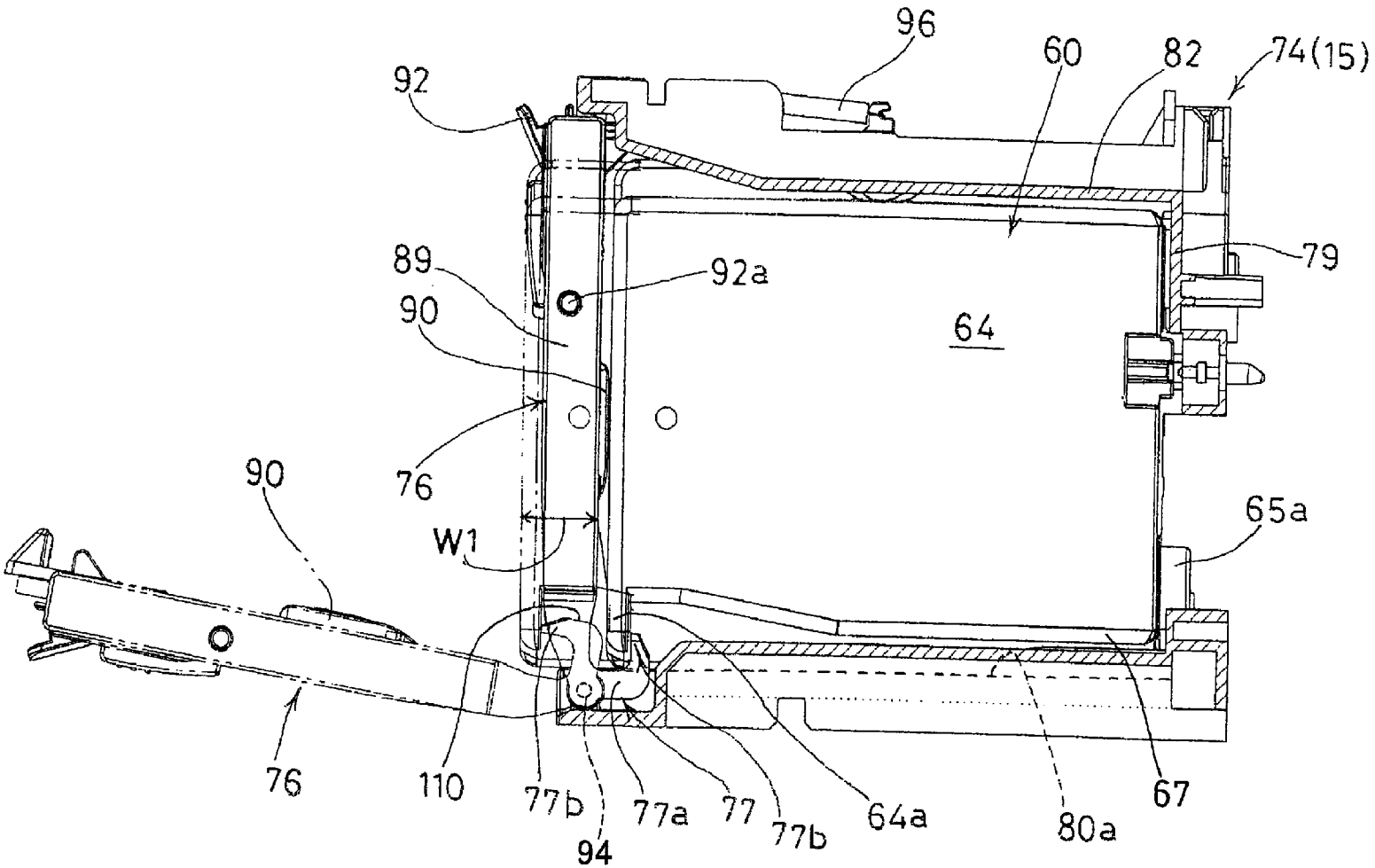
FIG. 8 shows a cross sectional side view of an ink cartridge installed in an ink cartridge storage unit.

Furthermore, as shown in FIG. 8 and FIG. 9, on the bottom surface of the cartridge main body 64, guiding grooves 67 are arranged. The guiding grooves 67 extend along the insertion direction; that is, the lengthwise direction of the cartridge main body 64. Each guiding groove 67 is concavely formed in the boundary corner of the bottom surface and the side surface of the main body 64 (also see FIG. 5).

In the present embodiment, the guiding grooves 67 are formed in the left and right corners respectively. As shown in FIG. 9, the guiding groove 67 includes a first portion 67*a*, a second portion 67*b*, and a third portion 67*c*. The first portion 67*a* is a shallowly concaved groove. One end of the first portion 67*a* is open towards the rear side surface of the storage main body 74, when the ink cartridge 60 is installed in the storage main body 74. The second portion 67*b* is arranged in between the first portion 67*a* and the third portion 67*c*. The second portion 67*b* is a groove whose size enlarges towards the third portion 67*c*; that is, the depth of the second portion 67*b* deepens towards the third portion 67*c*. The groove of the third portion 67*c* is the deepest of the aforementioned portions 67*a*, 67*b* and 67*c*. The bottom surface of the third portion 67*c* is parallel to the remaining bottom surface 64*b*, that is the surface areas in which grooves have not been formed, of the cartridge main body 64. The distal end of the third portion 67*c* is covered by a hook member 64*a*, so that the groove 67 is not open towards the front side of the storage main body 64 (that is, the front opening 74*a* side of the ink cartridge storage unit 15). Therefore, the left and right corners of the bottom surface of the cartridge main body 64 are both curtailed by the guiding grooves 67, with the bottom surface 64*b* remaining (see FIG. 5 and FIG. 6B).

In the course of installing the ink cartridge 60, the bottom surface 64*b* is placed on the aforementioned guiding rails 80*a*, and guided thereon. The vertical position of the guiding rails 80*a* is configured so that the ink inducing tube 63 can be inserted into the ink inducing valve 65.

When the ink cartridge 60 is installed inside the storage room 78, the pushing rod 84 is pressed against the rear plate 79 and releases the air valve 85 of the ink cartridge 60. The liquid level sensor 87 is engaged with the sensed portion 66 of the ink cartridge 60. Such a configuration enables air to be induced into the cartridge main body 64 via the air valve 85, and the ink stored inside the cartridge main body 64 flows out to the print head 4 side.

Figure 11:
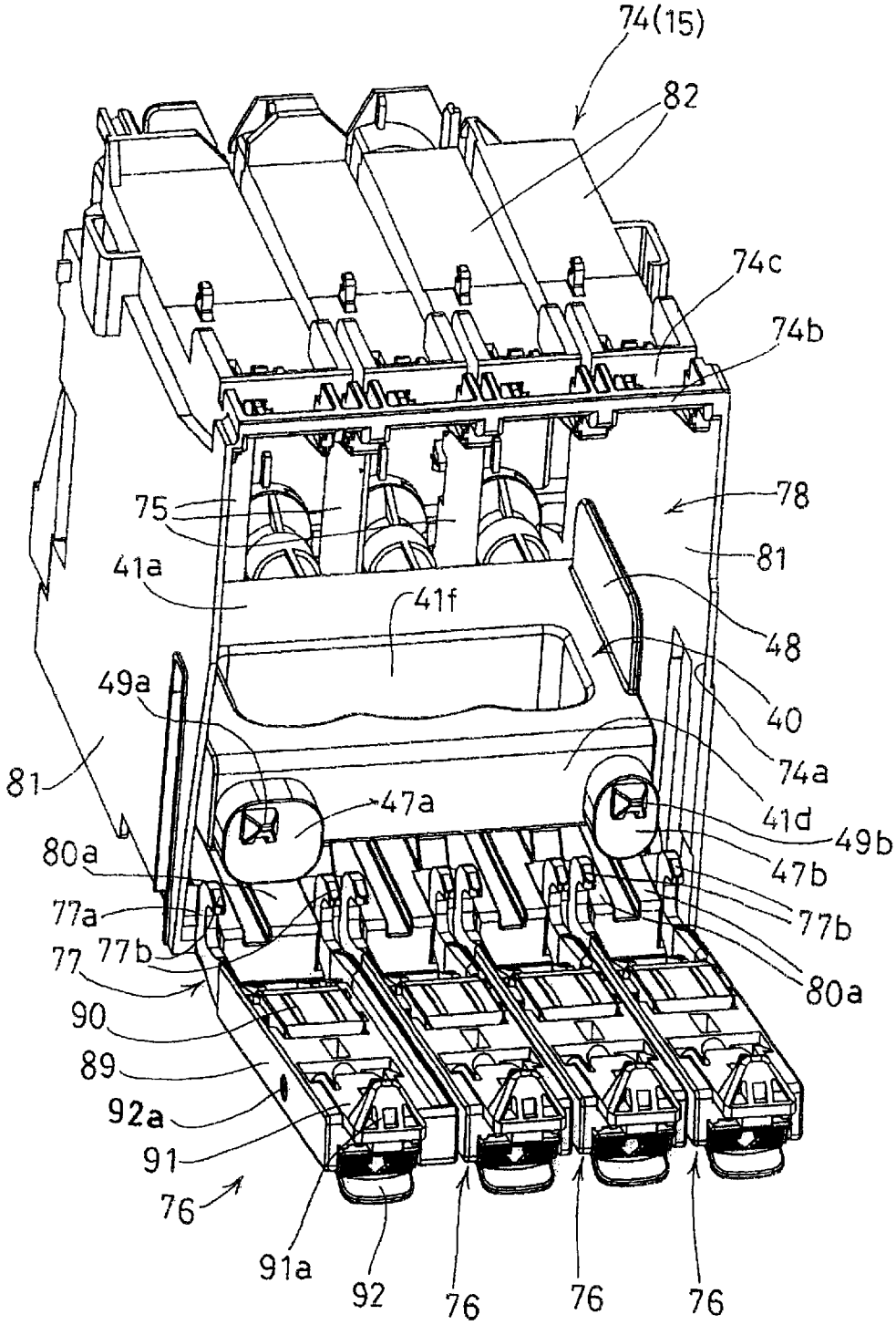
FIG. 11 shows a perspective view of a protection device installed in an ink cartridge storage unit.

As shown in FIG. 5 and FIG. 11, at the front opening 74*a* of the main body 74, a plurality of storage covers 76 is arranged. Each storage cover 76 corresponds to one of the storage rooms 78. The storage covers 76 are made of materials such as synthetic resin.

The storage cover 76 is connected to the lower edge of the storage main body 74 with a shaft 94. The storage cover 76 can rotate with respect to the storage main body 74 between the opened state and the closed state (see FIG. 5). In the opened state, the ink cartridges 60 can be inserted or removed through the front opening 74*a*. In the closed state with the ink cartridges 60 installed, the storage covers 76 holds the ink cartridges 60 in a stable position.

As clearly shown in FIG. 9, the storage cover 76 includes a cover main body 89, a weight support member 90, a lock member 91, and a lock release lever 92. The aforementioned components are made of synthetic resin.

On the lower end (the end connected to the storage main body 74) of the storage cover 89, a lever member 77 is formed on both the left and right side respectively (see FIG. 8). Each lever member 77 includes an elongated portion 77*a* and a curved portion 77*b*. The elongated portion 77*a* extends vertically from the cover main body. Simultaneously, the curved portion 77*b* extends from the distal end of the elongated portion 77*a*, and curves at a 90 degrees angle therefrom. As shown in FIG. 8, the curved portion 77*b* extends parallel to the cover main body 89 in the upper direction. The distal end of the curved portion 77*b* protrudes higher in the vertical direction than the top surfaces of the guiding rails 80*a*. Thus, as shown in FIG. 8, the hook member 64*a* of the ink cartridge 60 is caught by the curved portion 77*b* when in the closed state. In the course of opening the storage cover 76, the cover main body 89 and the lever member 77 are rotated frontward. The curved portion 77*b* slightly pulls out the ink cartridge 60 from the storage room 78 with the rotation of the curved portion 77*b*, and the shifting of the hook member 64*a* that accompanies the aforementioned rotation. In FIG. 8, the amount the ink cartridge 60 shifts is shown as W1. The dotted line of FIG. 8 shows the opened state of the storage cover 76 and the ink cartridge 60 after being slightly pulled out of the storage room 78.

As shown in FIG. 8, during the process of shifting the storage cover 76 into the opened state, the curved portion 77*b* of the lever member 77 rotates in a counter clockwise direction with respect to the shaft 94. The rotation causes an exterior surface 110 of the lever member 77 to move from a vertical standing state into a near-horizontal state with respect to the surface of the bottom plate 80. The elongated portion 77*a* of the lever member 77 is configured in a certain length size, so that the exterior surface 110 is positioned slightly higher than the surface of the guiding rails 80*a*. In this case, the exterior surface 110 guides the ink cartridge 60 onto the guiding rails 80*a* as it is being inserted into the storage room 78. This means that the lever member 77 functions as a component that pulls out the ink cartridge 60 from the storage room 78 during the removal process, and as a component that guides the ink cartridge 60 into the storage room 78 in the insertion process (see FIGS. 8 and 9).

Though not shown in the figures, a swing arm is arranged on the surface of the top plate 82 of the storage main body 74. The swing arm has an L-shape when viewed from the side, and is attached to the ceiling of each storage room 78 with a spring 96 (shown in FIGS. 5 and 8). When the ink cartridge 60 is installed inside the storage room 78, the swing arm holds the ink cartridge 60 down in the vertical direction with respect to the bottom plate 80. This means that a repulsive force from the ink cartridge 60 is exerted on the spring 96 during such state. FIG. 8 shows a cross sectional side view of the ink cartridge 60 installed in the ink cartridge storage unit 15, and FIG. 9 shows a cross sectional side view of the ink cartridge 60 being removed from the ink cartridge storage unit 15. When the storage cover 76 is opened, the ink cartridge 60 is pulled out to the position shown with dotted line in FIG. 8. Then, the ink cartridge 60 is further withdrawn to a position, for example, as shown in FIG. 9, by the force transmitted from the swing arm.

As shown in FIGS. 5, 6B, 8, 9, 11, and 12B, the weight support member 90 is slidably arranged on the interior surface (the surface side which faces the storage room 78 in the closed state) of the cover main body 89. The weight support member 90 is suspended on the cover main body 89 with a compressed coil spring (not shown in the figures) so as to maintain a protruding aspect. Hence, when the storage cover 76 is in its closed state with the ink cartridge 60 installed inside the storage main body 74, the weight support member 90 makes contact with the front side surface of the ink cartridge 60. The weight support member 90 presses against the ink cartridge 60 in a vertical direction with respect to the interior surface of the cover main body 89, and holds the ink cartridge 60 in a predetermined position inside the storage room 78.

The lock member 91 is slidably arranged at the upper end of the cover main body 89. The lock member 91 is able to slide horizontally with respect to the cover main body 89 within a predetermined range. As shown in FIG. 5, the lock member 91 includes a hook portion 91*a* that protrudes vertically with respect to the cover main body 89. The lock member 91 is suspended by a spring not shown in the figures, for the hook portion 91*a* to maintain the protruding posture. As shown in FIG. 6B, the upper surface of the hook portion 91*a* is angled. Hence, in the course of the storage cover 76 shifting into its closed state, the angled upper surface of the hook portion 91*a* makes contact with the upper edge portion 74*b* of the storage main body 74. As the storage cover 76 is rotated more towards the storage main body 74, the hook portion 91 is pressed down by the upper edge portion 74*b*, and the lock member 91 slides downward. The hook portion 91*a* is inserted into the insertion hole 74*c* that is located behind the upper edge portion 74*b*. When the hook portion 91*a* is fully inserted in the insertion hole 74*c*, the hook portion 91*a* is released from the pressure against the upper edge portion 74*b*. Thus, the lock member 91 slides upward, suspending the storage cover 76 to maintain its closed state. FIG. 6A shows the closed state of a storage cover 76 at the right most storage room 78. The other storage rooms 78 are shown without the storage covers 76.

As shown in FIGS. 5, 6A and 6B, the lock release lever 92 has the shape of a rectangular plate, and is arranged at the upper end of the exterior surface of the cover main body 89. The lock release lever 92 is connected to the cover main body 89 with a supporting pin 92*a*, and rotates with respect to the cover main body 89 (see FIG. 8). In the present embodiment, the lock release lever 92 is able to rotate between a state in which the lock release lever 92 is horizontal to the exterior surface of the cover main body 89 (see FIGS. 8 and 12B) and a state in which the lock release lever 92 is vertical to the exterior surface of the cover main body 89 (see FIG. 5). Within such a range, the lock release lever 92 can be rotated so that it is in an angled state (see FIG. 6B).

Figure 12A:
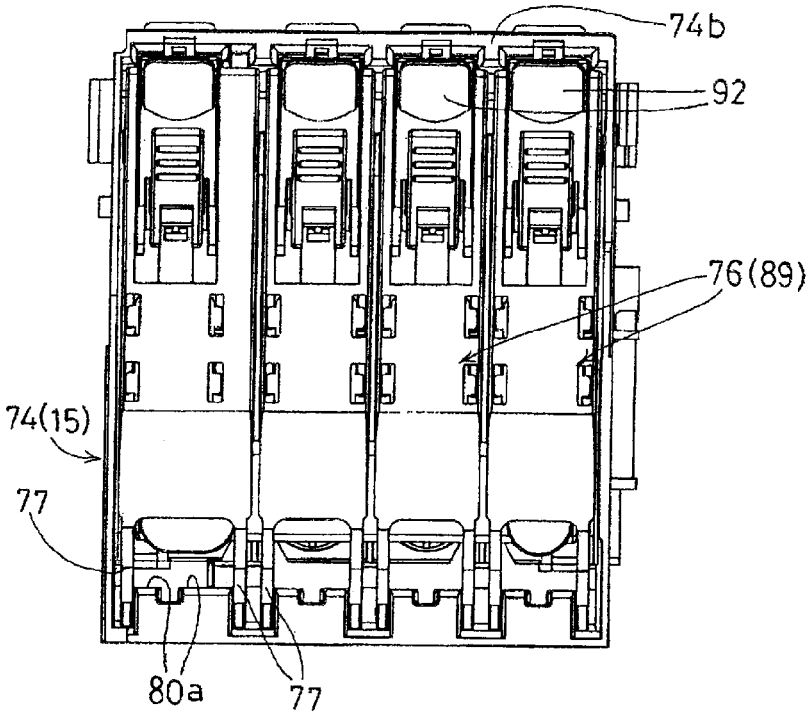
FIG. 12A shows a front view of an ink cartridge storage unit with a protection device installed.
Figure 12B:
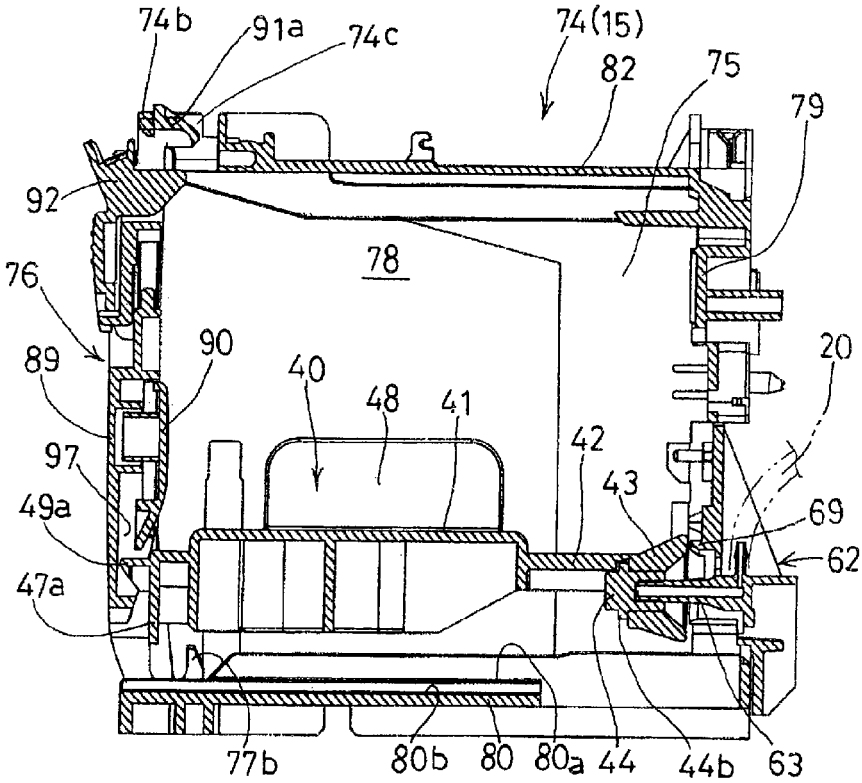
FIG. 12B shows a cross sectional side view of FIG. 12A.

The lock release lever 92 further includes a cam portion 92*b* (see FIG. 6B). When the storage cover 76 is in its closed state, as shown in FIGS. 12A and 12B, the lock member 91 and the lock release lever 92 are in horizontal position with respect to the cover main body 89. The lock release lever 92 is pulled downward from the horizontal state into either the angled or vertical state. The cam portion 92*b* makes contact with the lower part of the lock member 91, as shown in FIG. 6B, and presses the lock member 91 downward. The lock member 91 thus slides downward, releasing the hook portion 91*a* from the insertion hole 74*c*. The lock of the storage cover 76 is released, and the storage cover 76 can be rotated further into the opened state.

The ink cartridge 60 is replaced using the procedures described below. The storage cover 76 is opened, and the used ink cartridge 60 is removed from the storage room 78. In the course of rotating the storage cover 76 into the opened state, the curved portion 77*b* of the lever member 77 catches the hook member 64*a* of the cartridge main body 64, slightly sliding the cartridge main body 64 towards the front opening 74*a* side. The ink cartridge 60 can be easily withdrawn manually, because the rear part of the ink cartridge is pulled out of the storage room 78. When a new ink cartridge 60 is installed into the storage room 78, it is installed into the storage room 78 through the front opening 74*a*. The lower front side of the ink cartridge 60 is supported by the pair of lever members 77, and guided by the members into the storage room 78. Meanwhile, the bottom surface of the ink cartridge 60 slides along and above the guiding rails 80*a*. Within the configuration as mentioned, the ink cartridge 60 can be replaced easily and accurately.

With the new ink cartridge 60 installed inside the storage main body 74, the storage cover 76 can be rotated towards the closed state. In the course of rotating into the closed state, the weight support member 90 makes contact with the front side surface of the ink cartridge 60, and presses the ink cartridge 60 against the rear side surface of the storage room 78. When the hook portion 91*a* of the lock member 91 is fully inserted into the insertion hole 74*c*, the storage cover 76 is positioned in its closed state.

After the ink cartridge 60 is installed inside the storage main body 74, the ink inducing valve 65 of the ink cartridge 60 is connected to the ink inducing tube 63 of the connector 62. The ink from the ink cartridge 60 is provided to the print head 4 through the ink inducing tube 63 and the ink tube 20. Simultaneously, the air valve 85 is pressed against the storage main body 74, and the pushing rod 84 is pushed back inside the air valve 85. The checking valve is therefore opened, and air is induced into the cartridge main body 64 in accordance with the amount of ink provided to the print head 4. With the aforementioned configuration, efficient ink provision for the printer 7 can be achieved.

In the course of shipping or transporting the MFD 1, a protection device 40 is equipped inside the storage main body 74 instead of the ink cartridges 60. The configuration of the protection device 40 is described in the description below.

The embodiment of the protection device 40 is shown in FIGS. 10A to 10D. FIG. 10A, FIG. 10B, FIG. 10C and FIG. 10D show perspective views of the protection device 40, with each figure showing the protection device from a different angle. The protection device 40 of the present embodiment is configured to correspond to the ink cartridge storage unit 15 in which four ink cartridges 60 can be installed. Moreover, the protection device 40 of the present embodiment is configured to protect the ink inducing tube 63 that is arranged on the rear side surface that is vertical with respect to the bottom plate 80 of the storage main body 74.

The protection device 40 includes a flat-shaped main body 41, a plurality of supporting beams 42, funnel members 43 equipped at a distal end of each supporting beam 42, and elastic caps 44 equipped inside each funnel member 43. As shown in FIGS. 10A to 10D, the protection device 40 has a different shape compared to the sets of ink cartridges 60. As shown in the aforementioned figures, the main body 41 of the protection device 40 does not need to be formed in a shape that is similar or identical to the shape of the ink cartridge 60. The main body 41 of the present embodiment has a thin, rectangular parallelepiped shape.

The main body 41, the supporting beams 42, and the funnel members 43 are made of pliable materials such as synthetic resin, by using manufacturing methods such as injection molding, for example, and are formed as one component. The main body 41, the supporting beams 42, and the funnel members 43 can be made of other pliable materials, as long as the supporting beams 42 are resilient. The elastic caps 44 are made of a material with high pliability, such as compound rubber.

FIG. 12A shows a front view of the ink cartridge storage unit 15 with the protection device 40 installed, and FIG. 12B shows a cross sectional side view of FIG. 12A. As shown in FIG. 12B, each elastic cap 44 is cylindrically shaped, with a concave portion 44*a* formed at one end. The concave portion 44*a* (see FIG. 13A) is configured to fit with the distal end of the ink inducing tube 63. At the other end of the elastic cap 44, that is, the end inserted into the funnel member 43, a brim portion 44*b* is formed. The brim portion 44*b* has longer peripheral length than the main body portion of the elastic cap 44, and protrudes outward.

Since the protection device 40 has a different shape from the ink cartridge 60, it is not guided along the side surfaces of the separator 75, as is the case with the ink cartridges 60. In the course of inserting the protection device 40 inside the storage main body 74, the protection device 40 can be inserted, aiming the funnel member 43 so as to cover the ink inducing tube 63. The distal end of the ink inducing tube 63 is guided towards the concave portion 44*a* of the elastic cap 44 inside the funnel member 43, and engaged therewith, while the rear side surface (that is, the surface facing the front opening 74*a*) of the main body 41 is pressed against the interior side surface of the cover main body. The main body 41 of the protection device 40 can be maintained in horizontal alignment with respect to the bottom plate 80 of the storage main body 74, in such a manner that the main body 41 does not make contact with the guiding rails 80*a* nor the bottom plate 80. The elastic cap 44 is firmly fit with the distal end of the ink inducing tube 63 thus; the protection device 40 is prevented from being misaligned with respect to the ink inducing tube 63, or from falling off. A state in which the ink inducing tube 63 is tightly sealed can be maintained during the shipping or transporting the MFD 1.

Furthermore, since the protection device 40 is suspended inside the storage room 78 with a pressing force exerted horizontally on the main body 41 from the storage cover 76 and the rear side surface of the storage main body 74, it is preferred that the weight of the protection device 40 is minimized. Furthermore, in order to maintain the force exerted on the main body 41 efficiently, the main body 41 should comprise high pliability. For such reasons, the main body 41 and the supporting beams 42 are thinly formed in the present embodiment. Each supporting beam 42 is formed in a semicircular tube shape. The main body 41 has a structure similar to a hollow box with its bottom surface open. The main body 41 includes a top plate 41*a*, side plates 41*b* on left and right side respectively, a front plate 41*d*, and a rear plate 41*e*. At the rough center of the top plate 41*a*, a concave section 41*f* is formed. The concave section 41*f* is utilized as a grip in the course of inserting and removing the protection device 40 from the storage main body 74. As clearly shown in FIGS. 10B and 10D, a plurality of reinforcing ribs 41*g* are formed on the bottom side surface of the main body 41 (that is, the exterior side surface of the concave section 41*f*). The reinforcing ribs 41*g* each connects the exterior side surface of the concave section 41*f* with the side plate 41*b* on left side, the side plate 41*b* on right side, the front plate 41*d*, and the rear plate 41*e* respectively.

In the closed state of the storage cover 76, the storage cover 76 presses the main body 41 towards the rear side, and the funnel members 43 are pressed against the rear side surface of the storage main body 74. Coincidentally, the elastic caps 44 cover and seal the ink inducing tubes 63. The sealing between the ink inducing tubes 63 and the elastic caps 44 is enhanced by the pliability of the protection device 40 itself.

Figure 13A:
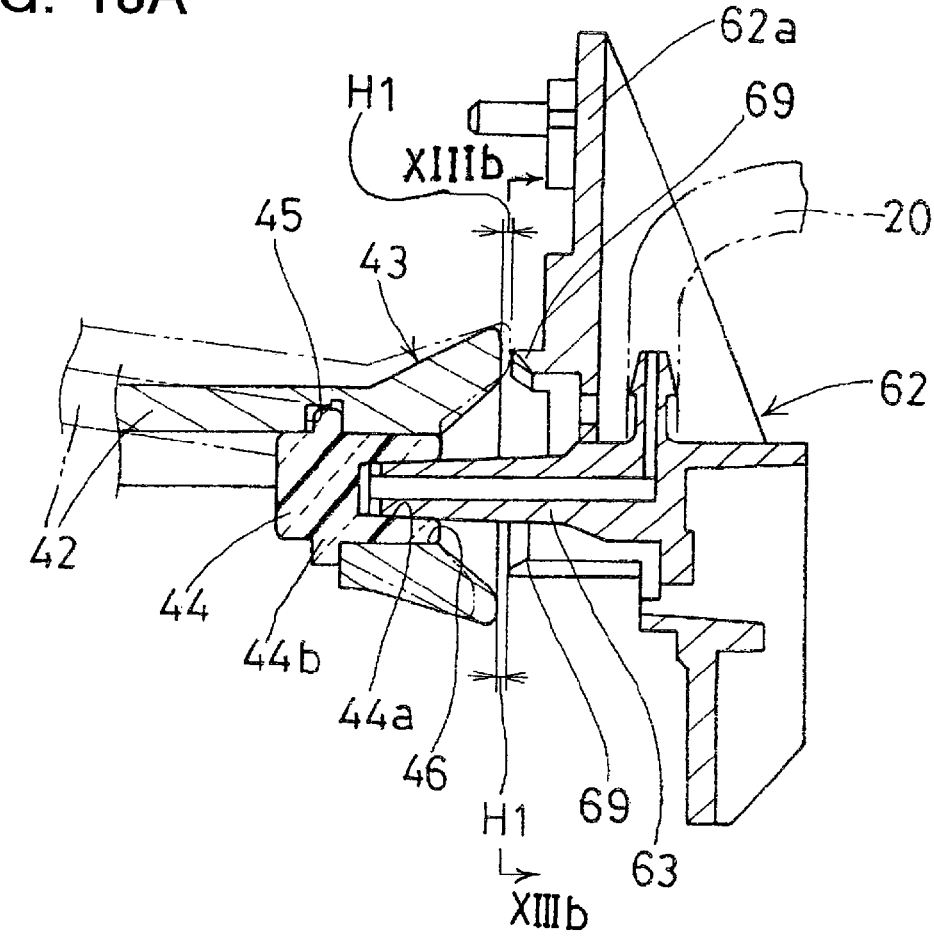
FIG. 13A shows an enlarged cross sectional side view of an ink inducing tube and a protection device.
Figure 13B:
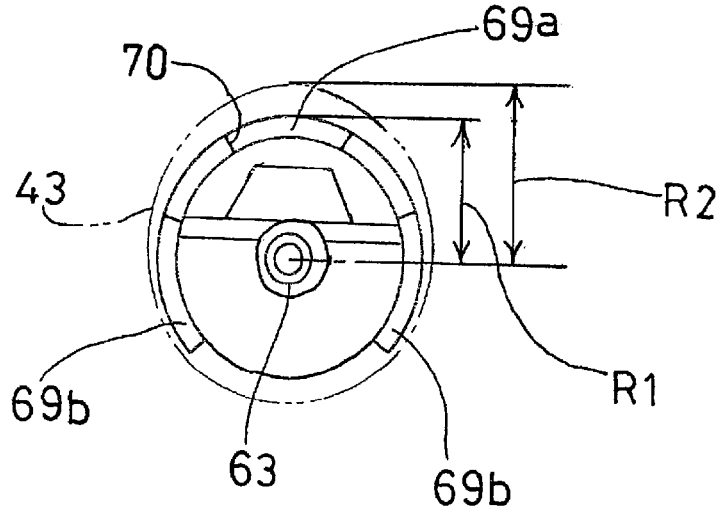
FIG. 13B shows an enlarged cross sectional front view of an ink inducing tube and a protection device.

FIG. 13A shows an enlarged cross sectional side view of the ink inducing tube 63 and a part of the protection device 40, and FIG. 13B shows an enlarged cross sectional front view of the ink inducing tube 36 and the protection device 40. At the connecting section of the supporting beam 42 and the funnel member 43, as shown in FIG. 13A, a semicircular groove 45 and an engagement hole 46 are formed. The semicircular groove 45 engages with roughly half of the periphery of the brim portion 44*b* of the elastic cap 44. The elastic cap 44 can be inserted within the engagement hole 46, which is formed on the interior surface of the funnel member 43. Such a configuration engages the brim portion 44*b* with the semicircular groove 45, thus suspending the elastic cap 44 at the connecting section of the supporting beam 42 and the funnel member 43 even when the elastic cap 44 is pressed in its axial direction by the insertion of the ink inducing tube 63. Furthermore, in the case where the protection device 40 is removed by manually pulling the concave section 41*f* (the grip), the elastic cap 44 remains in position due to the engagement between the brim portion 44*b* and the semicircular groove 45.

Since the supporting beam 42 is formed as a semicircular tube, and the connecting section of the supporting beam 42 and the funnel member 43 has the engagement hole 46, the elastic cap 44 can easily be inserted into the funnel member 43 via the hollow in the supporting beam 42 and into the engagement hole 46 which is connected to the aforementioned hollow section, even though the brim portion 44*b* has a longer peripheral length than the main body portion of the elastic cap 44.

Figure 10A:
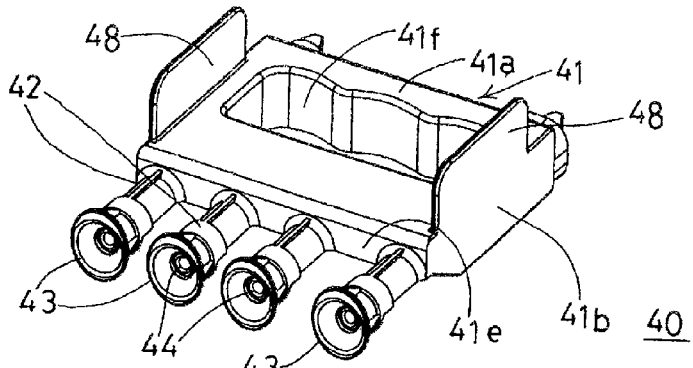
FIG. 10A, FIG. 10B, FIG. 10C and FIG. 10D show perspective views of a protection device from different angles.
Figure 10B:
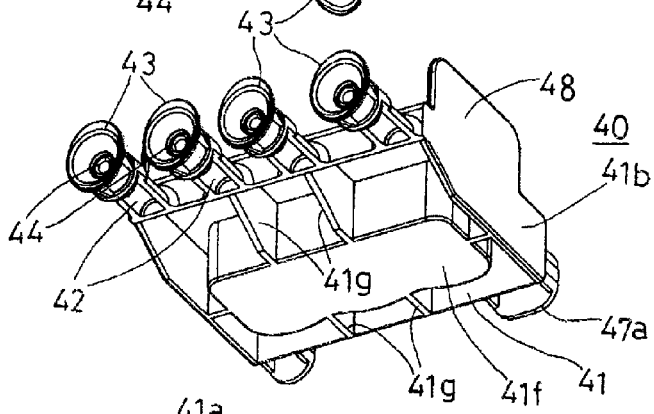
Figure 10C:
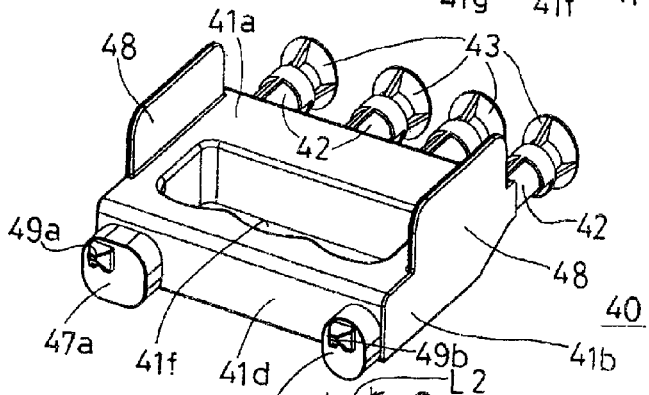
Figure 10D:
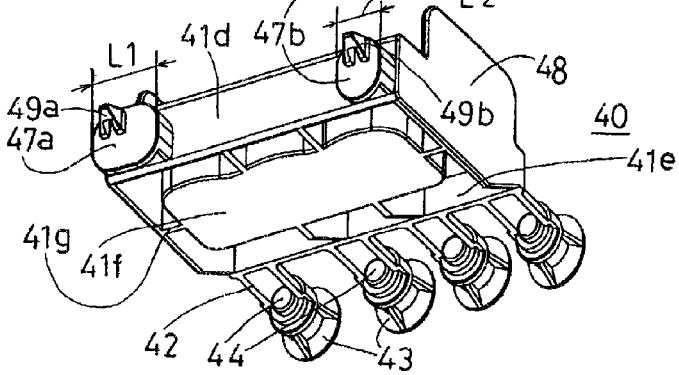

As shown in FIGS. 10C, 10D, and 11, guiding protrusions 47*a* and 47*b* are formed on the left and right sides of the front plate 41*d* respectively. FIG. 11 shows a perspective view of the protection device 40 installed in the ink cartridge storage unit 15.

The width of the guiding protrusions 47*a* and 47*b*, L1 and L2, each corresponds to the width between the curved portions 77*b* of the lever member 77 for the left most storage room 78 and the right most storage room 78 respectively. In FIG. 11, the width of the ink cartridge 60 that is inserted into the left most storage room 78 and the width of the ink cartridge 60 that is inserted into the right most storage room 78 differ, hence the width between the curved portions 77*b* differs as well. Thus, in accordance with the lever member 77, the width L1 and L2 of the guiding protrusions 47*a* and 47*b* are different. With such a configuration, even in a case where one of the storage covers 76 on either the left side or the right side is closed first, one of the guiding protrusions 47*a* and 47*b* is engaged with the corresponding lever member 77. One of the engaged guiding protrusions 47*a* or 47*b* is guided by the lever member 77, and the protection device 40 is horizontally pushed into the storage room 78.

Furthermore, as shown in FIG 10A, a fin 48 (a regulation plate) is formed at the corner of the top plate 41*a* and side plate 41*b* respectively on each side. It is preferable that the fins 48 have round corners or that the upper edges of the fins 48 are angled with the height of the fins 48 being lower on the supporting beam 42 side than the guiding protrusion 47*a*, 47*b* side. When the protection device 40 is inserted into the storage main body 74 in a wrong position, for example, with its topside down, the protection device 40 cannot be stably inserted with the fins 48 protruding in the lower direction. This is useful in recognizing the misaligned position of the protection device 40 in the course of inserting it into the ink cartridge storage unit 15.

Moreover, in the case where the protection device 40 is manually inserted into the storage main body 74, the concave section 41*f* is formed so that the index, middle, and third fingers can be put therein. The surface of the front plate 41*d* can be utilized as the holding position for the thumb. Such a configuration enables the protection device 40 to be held easily.

Furthermore, since the widths L1 and L2 of the guiding protrusions 47*a* and 47*b* are different, it is useful in recognizing a misaligned position of the protection device 40 in the course of inserting it into the storage main body 74.

Figure 14:
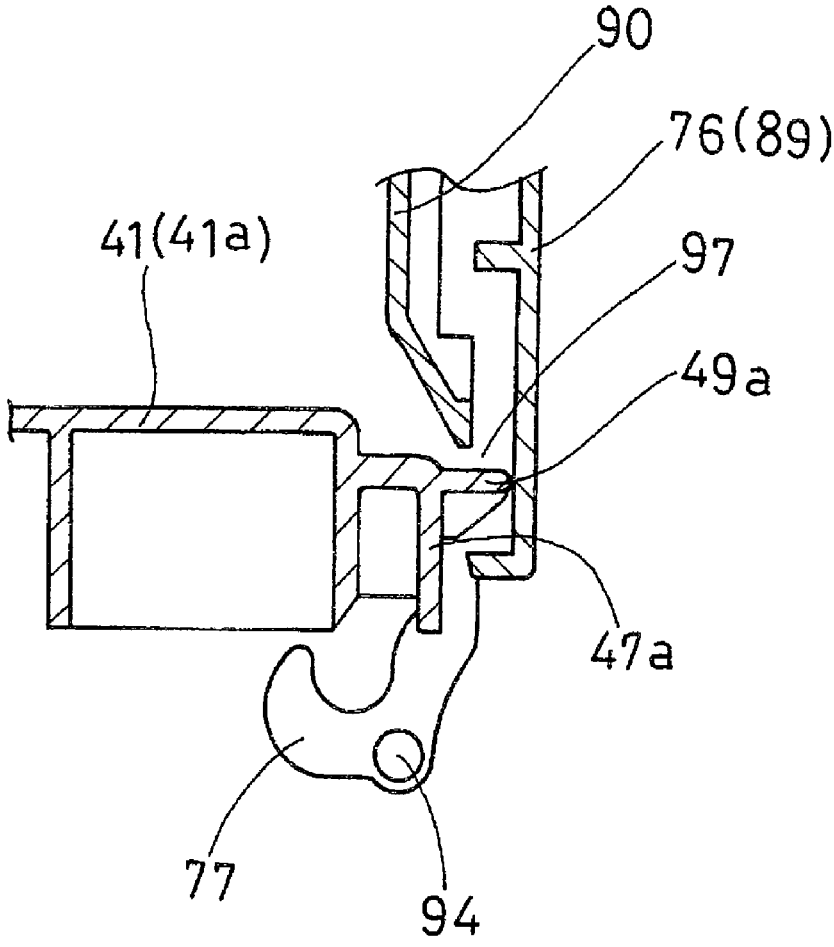
FIG. 14 shows an enlarged and notched cross sectional view of a storage cover and the rear portion of the protection device.

In the present embodiment, when the storage cover 76 is closed, the guiding protrusions 47*a* and 47*b* are pressed and supported by the interior side surface of the cover main body 89. In order to ensure the accurate alignment of the protection device 40 against the ink inducing tube 63, it is preferable that the guiding protrusions 47*a* and 47*b* each include a positioning protrusion 49*a*, 49*b* respectively. FIG. 14 shows an enlarged and notched cross sectional view of the storage cover 76 and the rear portion of the protection device 40 (also see FIGS. 10C, 10D, and 11). The positioning protrusions 49*a*, 49*b* are formed on their respective guiding protrusions 47*a*, 47*b*, each on a surface that faces the storage cover 76 in the closed state. On the cover main bodies 89, on the other hand, each includes a concave engaging portion 97 that corresponds to the positioning protrusions 47*a*, 47*b*. The positioning protrusions 47*a*, 47*b* are guided into the engaging portions 97 in the course of closing the storage cover 76, thus the alignment of the ink inducing tube 63 and the protection device 40 is determined.

In such a case, as clearly shown in FIG. 14, the positioning protrusions 47*a*, 47*b* have surface that narrows at an angle towards the distal end, and the distal end is rounded. Such a configuration of the positioning protrusions 47*a*, 47*b* enables the insertion into the engaging positions 97 to be easy. On the other hand, the engaging portions 97 may be tapered.

The fins 48 of the protection device 40 stand in the vertically upper direction with respect to the top plate 41*a* of the main body 41. They are utilized to provide notification of a misalignment of the protection device 40 in the course of insertion. If the protection device 40 is inserted into the storage main body 74 upside down, the funnel member 43 is placed at a position higher than where the ink inducing tube 63 is located. Thus, in a misaligned state, the fins 48 block the funnel member 43 from engaging with the ink inducing tube 63. Such a misalignment is easily recognized, and damage due to such a misalignment does not occur.

In the case where the fins 48 have the upper edge angled such that the height of the fins 48 on the supporting beam 42 side is lower than the height on the guiding protrusions 47*a*, 47*b* side, the protection device 40 is tilted when it is upside down. The funnel member 43 will be facing downward, hence the funnel members 43 cannot engage with the ink inducing tube 63 in such a state.

As shown in FIG. 13A, in a sealed state where the ink inducing tube 63 is engaged with the concave portion 44*a* of the elastic cap 44, a certain amount of clearance H1 is formed in between the rim of the funnel member 43 and the guiding ribs 69 of the connector 62.

Furthermore, as shown in FIG. 13B, the guiding ribs 69, that is, the arc-shaped guiding rib 69*a* and guiding ribs 69*b* with the notch 70 therebetween, have a radius of R1 with the axis of the ink inducing tube 63 as center of the radius R1. The rim of the funnel member 43 is formed so as to cover up the arc-shaped guiding ribs 69, with its rim in the shape of an egg, or an oval.

However, the rim of the funnel member 43 is not limited to the aforementioned shapes. It is able to have the form of an elongated round, covering the outer periphery of the guiding rib 69*a*. For such a configuration, the radius R2 of the edge of the funnel member 43 can be made greater than R1, or, the rim of the funnel member 43 is biased outwards at a part corresponding to the guiding rib 69*a*, with respect to the axis of the guiding ribs 69 (see the dotted line in FIG. 13B).

With such a clearance between the guiding ribs 69 and the funnel member 43, even when an ink leak occurs around the guiding ribs 69, the leaking ink can be prevented from dripping onto the funnel member 43.

Furthermore, even in the case where the protection device 40 is firmly pressed frontward in the course of insertion, the funnel member 43 cannot be inserted further than where the guiding ribs 69 are arranged. The ink inducing tube 63 is thus protected, preventing any damage thereof.

In the course of removing the protection device 40, the main body 41 can be lifted upward. During the lifting, a part of the interior surface of the elastic cap 44 that is pressed against the ink inducing tube 63 is constricted, and the upper rim of the funnel member 43 (that is, the part which has the radius R2) makes contact with the surface of the distal end of the guiding rib 69*a*. With the contact point acting as its leverage fulcrum, the main body 41 can be lifted higher. The elastic cap 44 is angled by the lifting, and the upper rim making contact with the distal surface of the guiding rib 69*a* slides downward while the position of the elastic cap 44 with respect to the ink inducing tube 63 is shifted with the constriction. As a result, the seal between the concave portion 44*a* and the ink inducing tube 63 is loosened. By forming the rim of the funnel member 43 in a partially elongated round, the funnel member 43 enables the elastic cap 44 to be unfastened from the ink inducing tube 63 with a small amount of effort.

In the case where the rim of the funnel member 43 is biased outwards, with respect to the axis of the guiding ribs 69, the biased section (that is, the section with elongated radius R2) should be formed parallel to the direction in which the fins 48 are orientated. In such a case, when the protection device 40 is inserted inside the storage main body 74 in the proper position with the fins 48 standing vertically upward with respect to the bottom plate 80 of the storage main body 74, damage resulting from the inappropriate removal of the elastic cap 44 can be reliably prevented.

In the present embodiment, the structure of the main body 41 of the protection device 40 is defined as a structure that partially occupies the space within the storage main body 74. For example, the main body 41 and the supporting beams 42 occupy less than about half the space required for storing the sets of ink cartridges 60.

The present invention can be embodied with the opening of the storage main body 74 formed in its top surface, with the ink inducing tube 63 arranged on the bottom surface inside the main body 74, orientated upward. The protection device 40 is then, in such a case, inserted through the opening at the top surface vertically with respect to the bottom side surface of the storage main body 74.

The embodiments described above referred to a printer of the off-carriage type, however the present invention can also be embodied with a printer of on-carriage type.

What is claimed is:

1. A protection device for an ink cartridge storage unit comprising a storage main body with one side having an opening, and an ink inducing member arranged on a surface of the storage main body facing the side having the opening, in a manner that the ink inducing member vertically protrudes inside the storage main body with respect to the surface, the protection device comprising:

a main body;

a supporting beam including one end and another end opposite to the one end, the one end of the supporting beam being connected to the main body of the protection device;

a funnel member having a narrow conical end and a wide conical end, the narrow conical end being connected to the another end of the supporting beam; and an elastic cap arranged inside the funnel member, wherein the elastic cap seals the ink inducing member in an engaged state;

wherein when the protection device is angled toward a direction, a part of the wide conical end corresponding to the direction makes contact with the surface where the ink inducing member is arranged and slides thereon.

2. The protection device as in claim 1, wherein the ink cartridge storage unit includes a guiding rib arranged along outer periphery of the ink inducing member, and the guiding rib has a surface facing the opening;

wherein the funnel member is configured so that a clearance is maintained between the wide conical end of the funnel member and the guiding rib of the ink cartridge storage unit in the engaged state, and when the protection device is angled toward a direction, a part of the wide conical end corresponding to the direction makes contact with the surface of the guiding rib and slides thereon.

3. The protection device as in claim 1, wherein:

a plurality of supporting beams ordered in a line is connected to a first surface of the main body of the protection device, the plurality of supporting beams aligned in a predetermined direction, a part of the wide conical end is elongated in an orthogonal direction with respect to the lengthwise direction of the supporting beams, and a plurality of guiding protrusions is connected to a second surface of the main body of the protection device that is opposite to the first surface, the plurality of guiding protrusions aligned in the predetermined direction.

4. The protection device as in claim 1, wherein the supporting beam is made of a pliable material and can be resiliently bent in the vertical direction with respect to its axis direction.

5. The protection device as in claim 4, wherein the supporting beam and the funnel member are made of a pliable material as one hollow component.

6. The protection device as in claim 1, wherein:

the elastic cap includes a brim portion, and the elastic cap is detachably inserted inside the funnel member with the brim portion on the supporting beam side.

7. The protection device as in claim 6, wherein:

a concave portion is formed at a connecting section of the supporting beam and the funnel member; and the brim portion of the elastic cap engages with the concave portion.

8. The protection device as in claim 1, further comprising:

a regulation plate connected to the main body of the protection device with respect to the surface at which the supporting beam is connected, wherein a height of the main body of the protection device is smaller than a height of an ink cartridge to be inserted into the ink cartridge storage unit.

9. The protection device as in claim 8, wherein the regulation plate allows the movement of the protection device in the horizontal direction with respect to the regulation plate.

* * * * *